US010165374B2

(12) United States Patent
Hillbratt et al.

(10) Patent No.: US 10,165,374 B2
(45) Date of Patent: Dec. 25, 2018

(54) PROSTHESIS STATE AND FEEDBACK PATH BASED PARAMETER MANAGEMENT

(71) Applicant: Cochlear Limited, Macquarie University (AU)

(72) Inventors: Martin Hillbratt, Lindome (SE); Mark Flynn, Gothenburg (SE); Bjorn Davidsson, Mölnlycke (SE)

(73) Assignee: Cochlear Limited, Macquarie University, NSW (AU)

( * ) Notice: Subject to any disclaimer, the term of this patent is extended or adjusted under 35 U.S.C. 154(b) by 0 days.

(21) Appl. No.: 15/088,981

(22) Filed: Apr. 1, 2016

(65) Prior Publication Data

US 2016/0219382 A1 Jul. 28, 2016

Related U.S. Application Data

(63) Continuation of application No. 13/910,622, filed on Jun. 5, 2013, now abandoned.

(51) Int. Cl.
*H04R 25/00* (2006.01)

(52) U.S. Cl.
CPC ..... *H04R 25/453* (2013.01); *H04R 25/30* (2013.01); *H04R 25/305* (2013.01); *H04R 25/70* (2013.01); *H04R 25/606* (2013.01); *H04R 2225/39* (2013.01); *H04R 2225/41* (2013.01)

(58) Field of Classification Search
CPC combination set(s) only.
See application file for complete search history.

(56) References Cited

U.S. PATENT DOCUMENTS

| | | | | |
|---|---|---|---|---|
| 6,738,486 | B2 * | 5/2004 | Kaulberg | H04R 25/453 381/318 |
| 2009/0067651 | A1 * | 3/2009 | Klinkby | H04R 25/453 381/313 |
| 2009/0310805 | A1 * | 12/2009 | Petroff | H04R 25/453 381/318 |
| 2010/0177917 | A1 * | 7/2010 | Van Der Werf | H04R 25/453 381/318 |
| 2012/0328118 | A1 * | 12/2012 | Pedersen | H04R 25/453 381/71.11 |
| 2013/0188796 | A1 * | 7/2013 | Kristensen | H04R 25/453 381/60 |

* cited by examiner

*Primary Examiner* — Amir Etesam
(74) *Attorney, Agent, or Firm* — Pilloff & Passino LLP; Martin J. Cosenza

(57) ABSTRACT

A method including obtaining data based on a current and/or anticipated future state of a hearing prosthesis and adjusting a set gain margin of the hearing prosthesis based on the current or anticipated future state of the hearing prosthesis.

21 Claims, 10 Drawing Sheets

PROSTHESIS STATE AND FEEDBACK PATH BASED PARAMETER MANAGEMENT

CROSS REFERENCE TO RELATED APPLICATIONS

This application is a continuation application of U.S. patent application Ser. No. 13/910,622, filed Jun. 5, 2013, which is hereby incorporated herein by reference in its entirety.

BACKGROUND

Hearing loss, which may be due to many different causes, is generally of two types: conductive and sensorineural. Sensorineural hearing loss is due to the absence or destruction of the hair cells in the cochlea that transduce sound signals into nerve impulses. Various hearing prostheses are commercially available to provide individuals suffering from sensorineural hearing loss with the ability to perceive sound.

Hearing loss, which may be due to many different causes, is generally of two types: conductive and sensorineural. Sensorineural hearing loss is due to the absence or destruction of the hair cells in the cochlea that transduce sound signals into nerve impulses. Various hearing prostheses are commercially available to provide individuals suffering from sensorineural hearing loss with the ability to perceive sound.

Conductive hearing loss occurs when the normal mechanical pathways that provide sound to hair cells in the cochlea are impeded, for example, by damage to the ossicular chain or the ear canal. Individuals suffering from conductive hearing loss may retain some form of residual hearing because the hair cells in the cochlea may remain undamaged.

Individuals suffering from conductive hearing loss typically receive an acoustic hearing aid. Hearing aids rely on principles of air conduction to transmit acoustic signals to the cochlea. In particular, a hearing aid typically uses an arrangement positioned in the recipient's ear canal or on the outer ear to amplify a sound received by the outer ear of the recipient. This amplified sound reaches the cochlea causing motion of the perilymph and stimulation of the auditory nerve.

In contrast to hearing aids, which rely primarily on the principles of air conduction, certain types of hearing prostheses commonly referred to as bone conduction devices, convert a received sound into vibrations. The vibrations are transferred through the skull to the cochlea causing generation of nerve impulses, which result in the perception of the received sound. In some instances, bone conduction devices can be used to treat single side deafness, where the bone conduction device is attached to the mastoid bone on the contra lateral side of the head from the functioning "ear" and transmission of the vibrations is transferred through the skull bone to the functioning ear. Bone conduction devices can be used, in some instances, to address pure conductive losses (faults on the pathway towards the cochlea) or mixed hearing losses (faults on the pathway in combination with moderate sensorineural hearing loss in the cochlea).

SUMMARY

In accordance with one aspect, there is a method comprising obtaining data based on a current and/or anticipated future state of a hearing prosthesis and adjusting a set gain margin of the hearing prosthesis based on the current or anticipated future state of the hearing prosthesis.

In accordance with another aspect, there is a method comprising obtaining feedback data indicative of a changed feedback path of a hearing prosthesis used by a recipient, and adjusting a parameter of the hearing prosthesis based on the obtained feedback data.

In accordance with another aspect, there is a device, comprising the hearing prosthesis is configured to at least one of record data based on feedback of the hearing prosthesis or detect a change in a state of the hearing prosthesis.

BRIEF DESCRIPTION OF THE DRAWINGS

Some embodiments are described below with reference to the attached drawings, in which.

DETAILED DESCRIPTION

Some and/or all embodiments of the technologies detailed herein by way of example and not by way of limitation can have utilitarian value when applied to various hearing prostheses. Two such exemplary hearing prostheses will first be described in the context of the human auditory system, followed by a description of some of the embodiments.

Figure 1A:
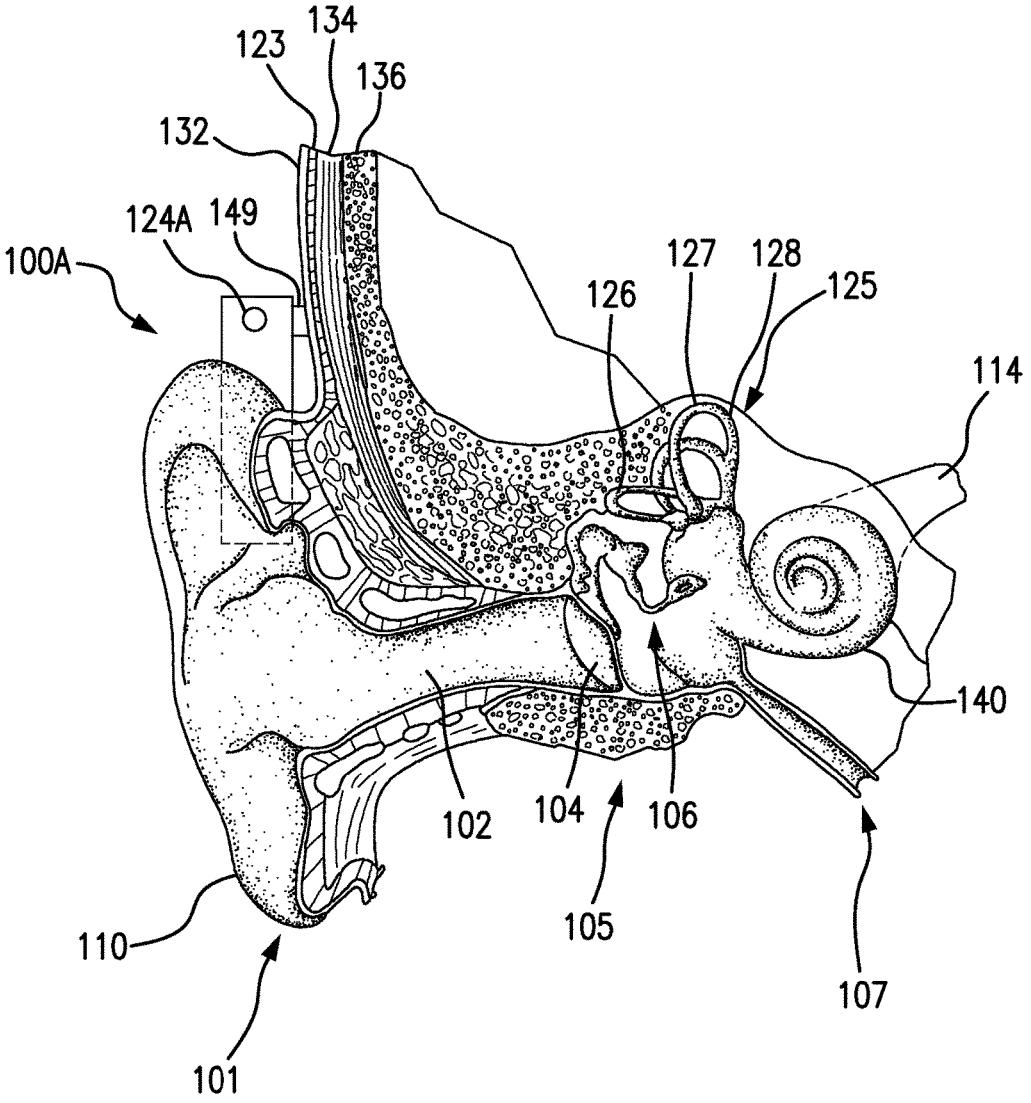
FIG. 1A is a perspective view of an exemplary bone conduction device in which at least some embodiments can be implemented.

FIG. 1A is a perspective view of a bone conduction device 100A in which embodiments may be implemented. As shown, the recipient has an outer ear 101 including ear canal 102, a middle ear 105 where the tympanic membrane 104 separates the two, and an inner ear 107. Some elements of outer ear 101, middle ear 105 and inner ear 107 are described below, followed by a description of bone conduction device 100.

FIG. 1A also illustrates the positioning of bone conduction device 100A relative to outer ear 101, middle ear 105 and inner ear 103 of a recipient of device 100. As shown, bone conduction device 100 is positioned behind outer ear 101 of the recipient and comprises a sound capture element 124A to receive sound signals. Sound capture element may comprise, for example, a microphone, telecoil, etc. Sound capture element 124A can be located, for example, on or in bone conduction device 100A, or on a cable extending from bone conduction device 100A.

Bone conduction device 100A can comprise an operationally removable component and a bone conduction implant. The operationally removable component is operationally releasably coupled to the bone conduction implant. By operationally releasably coupled, it is meant that it is releasable in such a manner that the recipient can relatively easily attach and remove the operationally removable component during normal use of the bone conduction device 100A. Such releasable coupling is accomplished via a coupling assembly of the operationally removable component and a corresponding mating apparatus of the bone conduction implant, as will be detailed below. This as contrasted with how the bone conduction implant is attached to the skull, as will also be detailed below. The operationally removable component includes a sound processor (not shown), a vibrating electromagnetic actuator and/or a vibrating piezoelectric actuator and/or other type of actuator (not shown—which are sometimes referred to herein as a species of the genus vibrator) and/or various other operational components, such as sound input device 124A. In this regard, the operationally removable component is sometimes referred to herein as a vibrator unit and/or an actuator. More particularly, sound input device 124A (e.g., a microphone) converts received sound signals into electrical signals. These electrical signals are processed by the sound processor. The sound processor generates control signals which cause the actuator to vibrate. In other words, the actuator converts the electrical signals into mechanical motion to impart vibrations to the recipient's skull.

As illustrated, the operationally removable component of the bone conduction device 100A further includes a coupling assembly 149 configured to operationally removably attach the operationally removable component to a bone conduction implant (also referred to as an anchor system and/or a fixation system) which is implanted in the recipient. With respect to FIG. 1A, coupling assembly 149 is coupled to the bone conduction implant (not shown) implanted in the recipient in a manner that is further detailed below with respect to exemplary bone conduction implants. Briefly, an exemplary bone conduction implant may include a percutaneous abutment attached to a bone fixture via a screw, the bone fixture being fixed to the recipient's skull bone 136. The abutment extends from the bone fixture which is screwed into bone 136, through muscle 134, fat 128 and skin 232 so that the coupling assembly may be attached thereto. Such a percutaneous abutment provides an attachment location for the coupling assembly that facilitates efficient transmission of mechanical force.

It is noted that while many of the details of the embodiments presented herein are described with respect to a percutaneous bone conduction device, some or all of the teachings disclosed herein may be utilized in transcutaneous bone conduction devices and/or other devices that utilize a vibrating electromagnetic actuator. For example, embodiments include active transcutaneous bone conduction systems utilizing the electromagnetic actuators disclosed herein and variations thereof where at least one active component (e.g. the electromagnetic actuator) is implanted beneath the skin. Embodiments also include passive transcutaneous bone conduction systems utilizing the electromagnetic actuators disclosed herein and variations thereof where no active component (e.g., the electromagnetic actuator) is implanted beneath the skin (it is instead located in an external device), and the implantable part is, for instance a magnetic pressure plate. Some embodiments of the passive transcutaneous bone conduction systems are configured for use where the vibrator (located in an external device) containing the electromagnetic actuator is held in place by pressing the vibrator against the skin of the recipient. In an exemplary embodiment, an implantable holding assembly is implanted in the recipient that is configured to press the bone conduction device against the skin of the recipient. In other embodiments, the vibrator is held against the skin via a magnetic coupling (magnetic material and/or magnets being implanted in the recipient and the vibrator having a magnet and/or magnetic material to complete the magnetic circuit, thereby coupling the vibrator to the recipient).

Figure 1B:
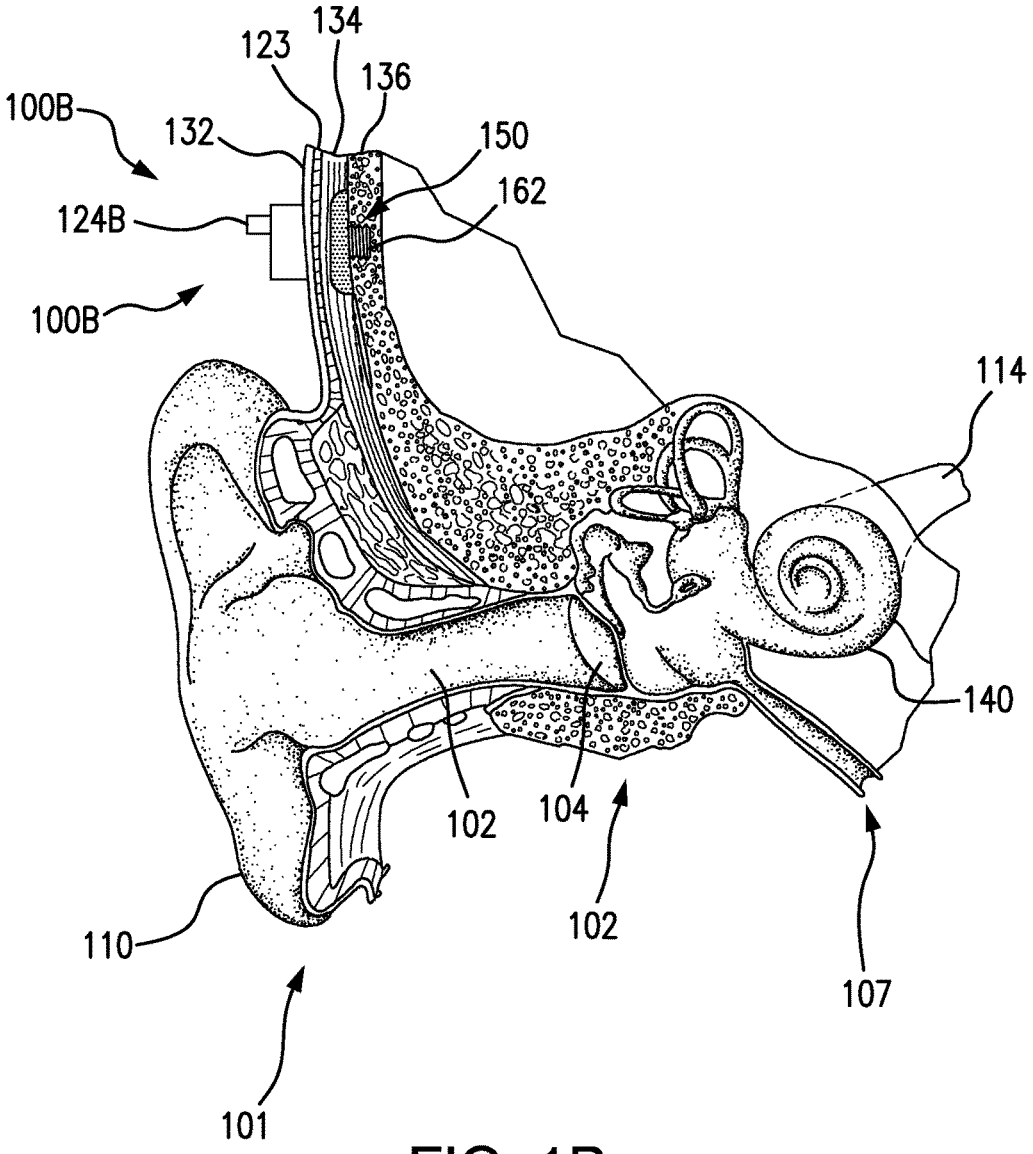
FIG. 1B is a perspective view of an alternate exemplary bone conduction device in which at least some embodiments can be implemented.

More specifically, FIG. 1B is a perspective view of a transcutaneous bone conduction device 100B in which embodiments can be implemented.

FIG. 1B also illustrates the positioning of bone conduction device 100B relative to outer ear 101, middle ear 105 and inner ear 107 of a recipient of device 100. As shown, bone conduction device 100 is positioned behind outer ear 101 of the recipient. Bone conduction device 100B comprises an external component 140B and implantable component 150. The bone conduction device 100B includes a sound capture element 124B to receive sound signals. As with sound capture element 124A, sound capture element 124B may comprise, for example, a microphone, telecoil, etc. Sound capture element 124B may be located, for example, on or in bone conduction device 100B, on a cable or tube extending from bone conduction device 100B, etc. Alternatively, sound capture element 124B may be subcutaneously implanted in the recipient, or positioned in the recipient's ear. Sound capture element 124B may also be a component that receives an electronic signal indicative of sound, such as, for example, from an external audio device. For example, sound capture element 124B may receive a sound signal in the form of an electrical signal from an MP3 player electronically connected to sound capture element 124B.

Bone conduction device 100B comprises a sound processor (not shown), an actuator (also not shown) and/or various other operational components. In operation, sound capture element 124B converts received sounds into electrical signals. These electrical signals are utilized by the sound processor to generate control signals that cause the actuator to vibrate. In other words, the actuator converts the electrical signals into mechanical vibrations for delivery to the recipient's skull.

A fixation system 162 may be used to secure implantable component 150 to skull 136. As described below, fixation system 162 may be a bone screw fixed to skull 136, and also attached to implantable component 150.

In one arrangement of FIG. 1B, bone conduction device 100B can be a passive transcutaneous bone conduction device. That is, no active components, such as the actuator, are implanted beneath the recipient's skin 132. In such an arrangement, the active actuator is located in external component 140B, and implantable component 150 includes a magnetic plate, as will be discussed in greater detail below. The magnetic plate of the implantable component 150 vibrates in response to vibration transmitted through the skin, mechanically and/or via a magnetic field, that are generated by an external magnetic plate.

In another arrangement of FIG. 1B, bone conduction device 100B can be an active transcutaneous bone conduction device where at least one active component, such as the actuator, is implanted beneath the recipient's skin 132 and is thus part of the implantable component 150. As described below, in such an arrangement, external component 140B may comprise a sound processor and transmitter, while implantable component 150 may comprise a signal receiver and/or various other electronic circuits/devices.

Figure 2A:
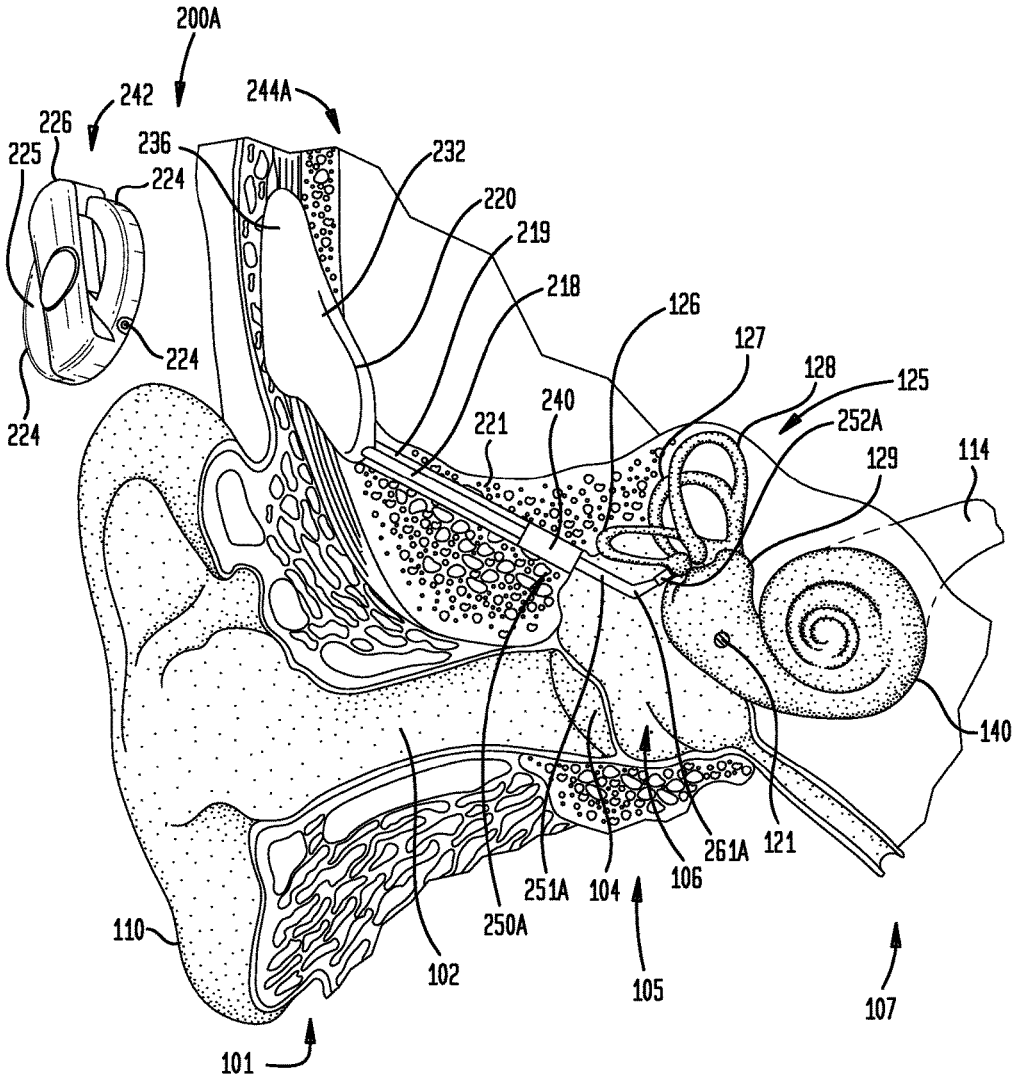
FIG. 2A is a perspective view of an exemplary direct acoustic cochlear stimulator implanted in accordance with embodiments of the present invention.

FIG. 2A is a perspective view of an exemplary direct acoustic cochlear stimulator 200A in accordance with embodiments of the present invention. Direct acoustic cochlear stimulator 200A comprises an external component 242 that is directly or indirectly attached to the body of the recipient, and an internal component 244A that is temporarily or permanently implanted in the recipient. External component 242 typically comprises two or more sound capture elements, such as microphones 224, for detecting sound, a sound processing unit 226, a power source (not shown), and an external transmitter unit 225. External transmitter unit 225 comprises an external coil (not shown). Sound processing unit 226 processes the output of microphones 224 and generates encoded data signals which are provided to external transmitter unit 225. For ease of illustration, sound processing unit 226 is shown detached from the recipient.

Internal component 244A comprises an internal receiver unit 232, a stimulator unit 220, and a stimulation arrangement 250A in electrical communication with stimulator unit 220 via cable 218 extending thorough artificial passageway 219 in mastoid bone 221. Internal receiver unit 232 and stimulator unit 220 are hermetically sealed within a biocompatible housing, and are sometimes collectively referred to as a stimulator/receiver unit.

In the illustrative scenario of FIG. 2A, ossicles 106 have been explanted. However, it should be appreciated that stimulation arrangement 250A may be implanted without disturbing ossicles 106.

Stimulation arrangement 250A comprises an actuator 240, a stapes prosthesis 252A and a coupling element 251A which includes an artificial incus 261B. Actuator 240 is osseointegrated to mastoid bone 221, or more particularly, to the interior of artificial passageway 219 formed in mastoid bone 221.

Stimulation arrangement 250A is implanted and/or configured such that a portion of stapes prosthesis 252A abuts an opening in one of the semicircular canals 125. For example, stapes prosthesis 252A abuts an opening in horizontal semicircular canal 126. In an alternative case, stimulation arrangement 250A is implanted such that stapes prosthesis 252A abuts an opening in posterior semicircular canal 127 or superior semicircular canal 128.

As noted above, a sound signal is received by microphone(s) 224, processed by sound processing unit 226, and transmitted as encoded data signals to internal receiver 232. Based on these received signals, stimulator unit 220 generates drive signals which cause actuation of actuator 240. The mechanical motion of actuator 240 is transferred to stapes prosthesis 252A such that a wave of fluid motion is generated in horizontal semicircular canal 126. Because, vestibule 129 provides fluid communication between the semicircular canals 125 and the median canal, the wave of fluid motion continues into median canal, thereby activating the hair cells of the organ of *Corti*. Activation of the hair cells causes appropriate nerve impulses to be generated and transferred through the spiral ganglion cells (not shown) and auditory nerve 114 to cause a hearing percept in the brain.

Figure 2B:
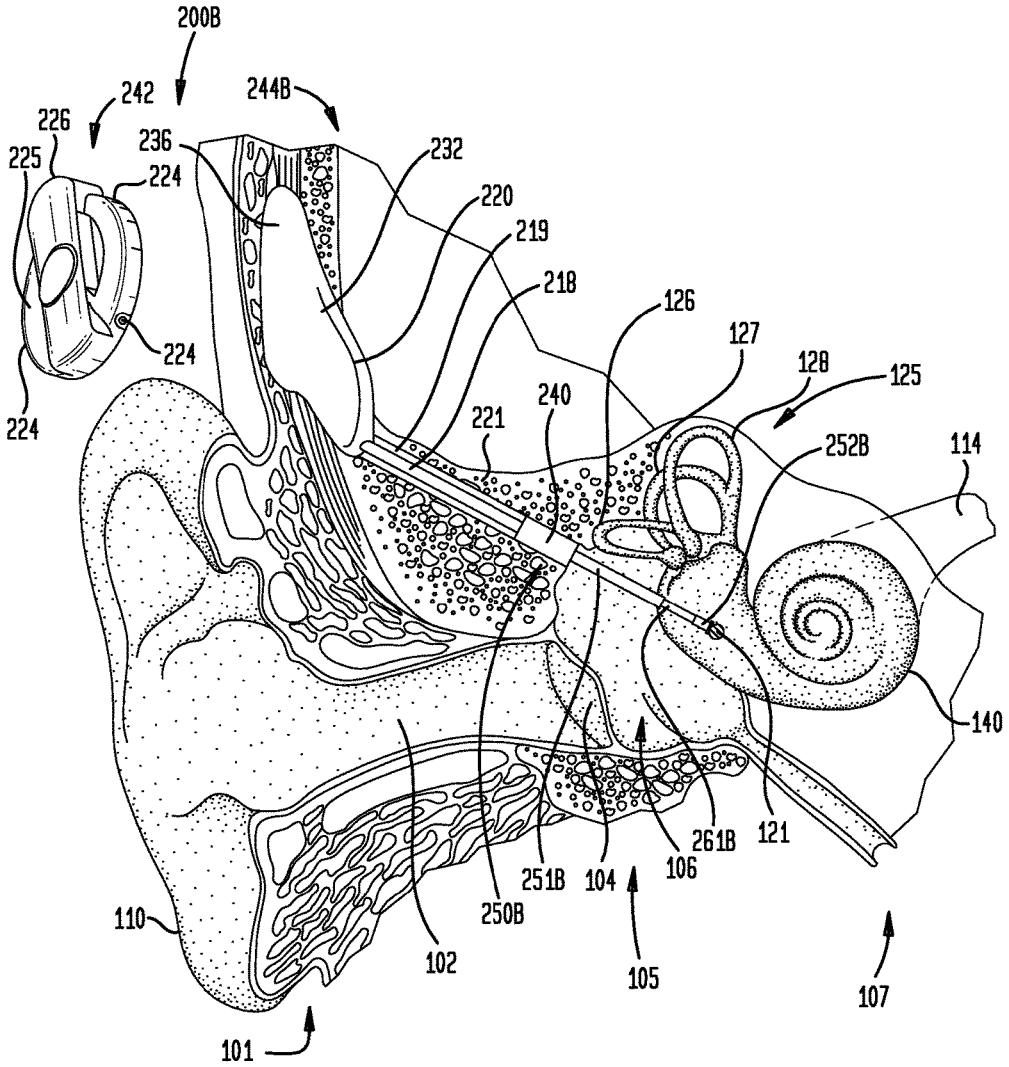
FIG. 2B is a perspective view of an exemplary direct acoustic cochlear stimulator implanted in accordance with an embodiment of the present invention.

FIG. 2B is a perspective view of another type of direct acoustic cochlear stimulator 200B. Direct acoustic cochlear stimulator 200B comprises external component 242 and an internal component 244B.

Stimulation arrangement 250B comprises actuator 240, a stapes prosthesis 252B and a coupling element 251B which includes artificial incus 261B which couples the actuator to the stapes prosthesis. Stimulation arrangement 250B is implanted and/or configured such that a portion of stapes prosthesis 252B abuts round window 121 of cochlea 140.

Figure 2C:
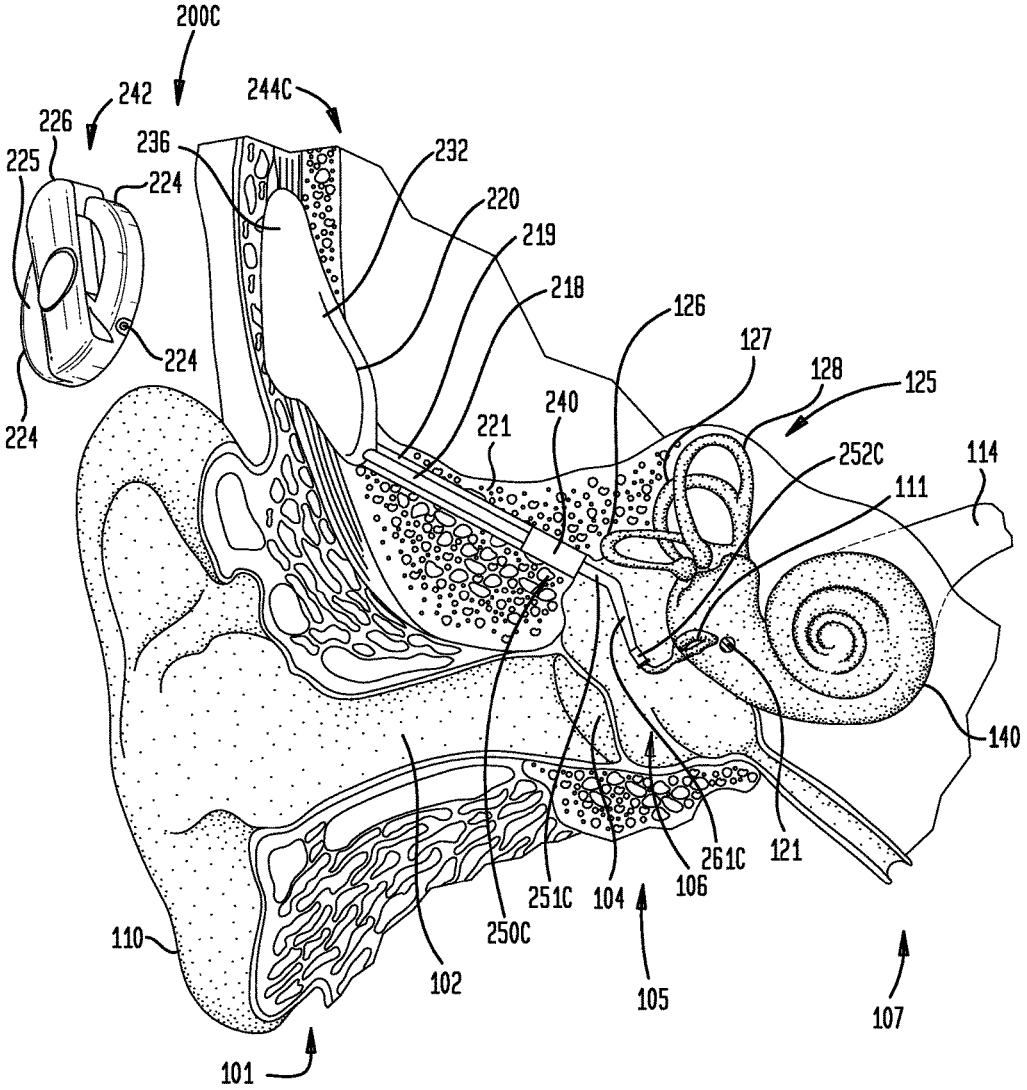
FIG. 2C is a perspective view of an exemplary direct acoustic cochlear stimulator implanted in accordance with an embodiment of the present invention.

FIGS. 2A and 2B are exemplary middle ear implants that provide mechanical stimulation directly to cochlea 140. Other types of middle ear implants provide mechanical stimulation to middle ear 105. For example, middle ear implants may provide mechanical stimulation to a bone of ossicles 106, such to incus 109 or stapes 111. FIG. 2C depicts an exemplary middle ear implant 200C having a stimulation arrangement 250C comprising actuator 240 and a coupling element 251C. Coupling element 251C includes a stapes prosthesis 252C and an artificial incus 261C which couples the actuator to the stapes prosthesis. Stapes prosthesis 252C abuts stapes 111.

The bone conduction devices 100A and 100B include a component that moves in a reciprocating manner to evoke a hearing percept. The direct acoustic cochlear stimulators 200A, 200B and 200C also include a component that moves in a reciprocating manner evoke a hearing percept. The movement of these components results in the creation of vibrational energy where at least a portion of which is ultimately transmitted to the sound capture element(s) of the hearing prosthesis. In the case of the active transcutaneous bone conduction device 100B and direct acoustic stimulators 200A, 200B, 200C, in at least some scenarios of use, all or at least a significant amount of the vibrational energy transmitted to the sound capture device from the aforementioned component is conducted via the skin, muscle and fat of the recipient to reach the operationally removable component/external component and then to the sound capture element(s). In the case of the bone conduction device 100A and the passive transcutaneous bone conduction device 100B, in at least some scenarios of use, all or at least a significant amount of the vibrational energy that is transmitted to the sound capture device is conducted via the unit (the operationally removable component/the external component) that contains or otherwise supports the component that moves in a reciprocating manner to the sound capture element(s) (e.g., because that unit also contains or otherwise supports the sound capture element(s)). In some examples of these hearing prostheses, other transmission routes exist (e.g., through the air, etc.) and the transmission route can be a combination thereof. Regardless of the transmission route, energy originating from operational movement of the hearing prostheses to evoke a hearing percept that impinges upon the sound capture device, such that the output of the sound capture device is influenced by the energy, is referred to herein as physical feedback.

Figure 3:
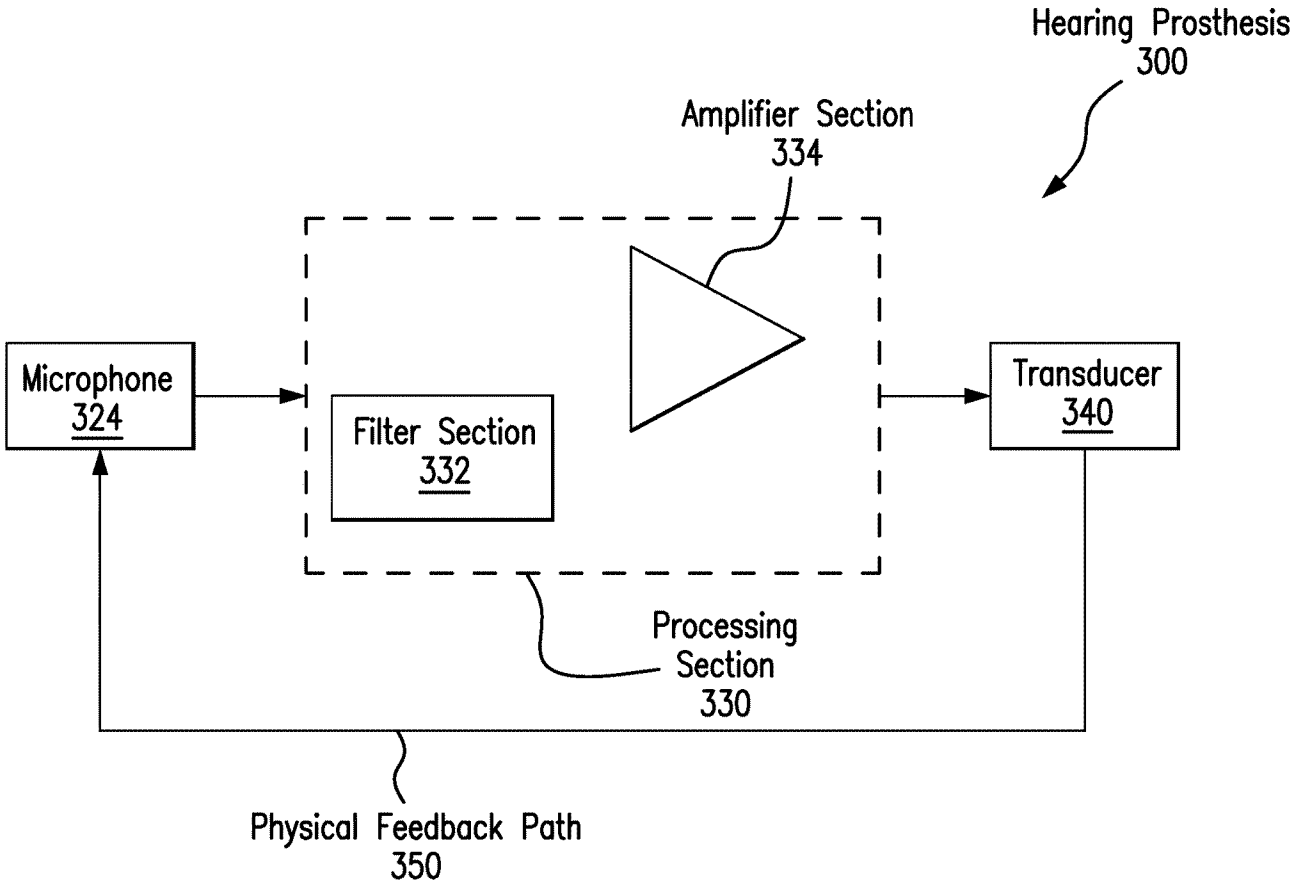
FIG. 3 is a functional diagram of an exemplary hearing prosthesis.

In broad conceptual terms, the above hearing prostheses and other types of hearing prostheses (e.g., conventional hearing aids, which the teachings herein and/or variations thereof are also applicable), operate on the principle illustrated in FIG. 3, with respect to hearing prosthesis 300. Specifically, sound is captured via microphone 324 and is transduced into an electrical signal that is delivered to processing section 330. Processing section 330 includes various elements and performs various functions. However, in the broadest sense, the processing section 330 includes a filter section 332, where, in at least some examples, includes is a series of filters, and an amplifier section 334, which amplifies the output of the processing section 330. (Note that in some instances, the signal from microphone 324 is amplified prior to receipt by filter section 332, and in other instances the application occurs after filter section 332 filters the signal from microphone 324. In some instances, amplification occurs both before and after the filter section 332 performs its function.) Processing section 330 can divide the signal received from microphone 324 into various frequency components and processes the different frequency components in different manners. Some frequency components are amplified more than other frequency components. The output of processing section 330 is one or more signals that are delivered to transducer 340, which converts the output to mechanical energy (or, in the case of a conventional hearing aid, acoustic energy) that evokes a hearing percept.

FIG. 3 further functionally depicts the physical feedback path 350 of the hearing prostheses. In some instances, the amount of feedback received by microphone 324, or, more accurately, the amount of influence of the feedback on the output of the microphone 324 limits the amount of gain that the processing section 330 applies to the received signal from the microphone 324, in totality and/or on a frequency by frequency basis. The amount of influence translates to a so-called gain margin of the processing section 330, which correlates to a frequency dependent maximum gain that is deemed to provide a utilitarian hearing percept evoking experience without subjecting the recipient to an unacceptable amount/level of feedback influenced hearing percepts, which includes none at all (hereinafter, the "feedback path gain margin"—note that this term as used is a physical characteristic of the individual prostheses that exists irrespective of whether its value is obtained). Put another way, the physical feedback influences, or, more specifically, places limits on the highest value that can be set for the gain margin of the processing section 330. In at least some instances, the greater the influence of feedback on the output of the microphone 324, the lower the gain margin of the processing section 330. All things being equal, in at least some instances, higher values of gain margin have more utilitarian value than lower values of gain margin.

At least some of the hearing prostheses detailed herein and/or variations thereof include a feature that enables the gain margin to be set in the prosthesis. Some can include a hearing prosthesis that enables the gain margin to be set to a setting that is individualized to a specific prosthesis/user combination, as will be detailed below.

In at least some instances, the gain margin is set based on data relating to feedback influence (by itself, constituting the feedback path gain margin) and also based on what will be referred to herein as a safety factor gain margin. In at least some instances, the safety factor gain margin constitutes a gain margin that is subtracted from the feedback path gain margin.

An example of the safety factor gain margin is one that accounts for the potential for the feedback path to vary during the expected temporal period between one gain margin setting and a potential subsequent gain margin setting (which might be never, in which case the temporal period is the expected life of the hearing prosthesis). This change can impact, sometimes, deleteriously, the gain margin of the hearing prosthesis. By way of example, a gain margin can be set, in totality and/or on a frequency by frequency basis, during a so-called fitting session based on a measurement of the feedback path gain margin obtained from the hearing prosthesis while the hearing prosthesis is attached to the recipient and based on a safety factor gain margin. In at least some instances, the set gain margin is the feedback path gain margin minus the safety factor gain margin, and accordingly, the set gain margin is based on the safety factor gain margin (as well as the feedback path gain margin).

Some exemplary instances of determining or otherwise obtaining a value for the feedback path gain margin will now be described.

Figure 4:
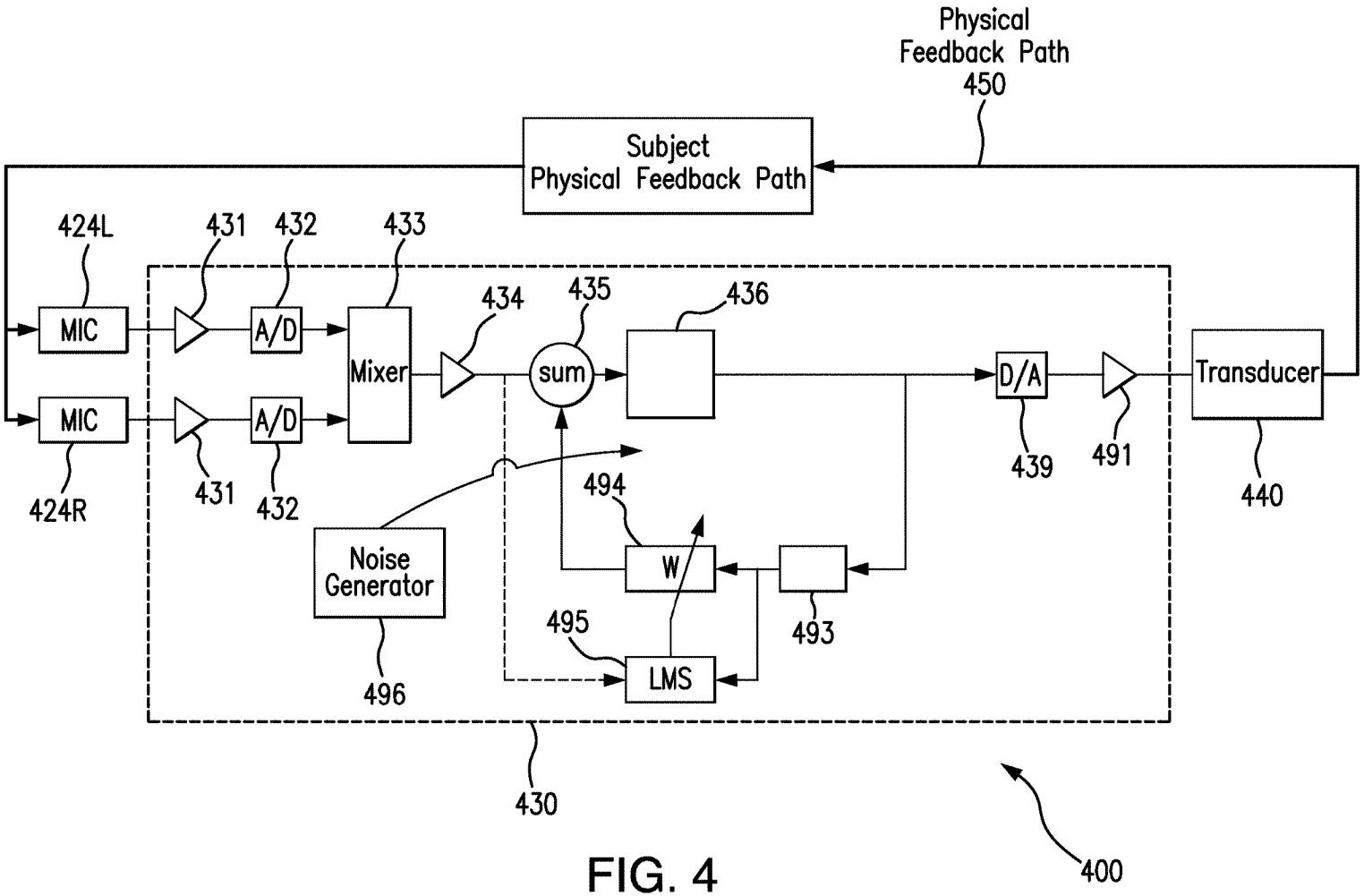
FIG. 4 is a functional diagraph depicting additional details of the hearing prosthesis of FIG. 3.

FIG. 4 functionally depicts an exemplary hearing prosthesis 400 and a physical feedback path of an exemplary hearing prosthesis corresponding to that of FIG. 3 (in greater detail), having a configuration such that the feedback path gain margin of the hearing prostheses can be measured or otherwise estimated while attached to the recipient. More particularly, microphones 424L and 424R correspond to microphone 324 of FIG. 3, processing section 430 corresponds to processing section 330 of FIG. 3, and transducer 440 corresponds to transducer 340 of FIG. 3. Physical feedback path 450 corresponds to path 350 of FIG. 3. Still referring to FIG. 4, as can be seen, the processing section 430 includes amplifiers 431, analog to digital converters 432, mixer 433, amplifier 434, summation device 435, gain equalizer 436, digital to analog converter 439 and amplifier 491. Processing section 430 further includes a feedback cancellation system that includes a pre-filter 493, filter system 494 having adjustable filter coefficients which is in communication with least mean squares block 495, the latter two elements collectively forming a least means squares filter system. As can be seen, the processing section 430 further includes a noise generator 496, which can be variously placed into and taken out of signal communication with the other components of the processing section 430, so as to input a noise into the system as will be detailed below.

By way of example, the hearing prostheses 400 can be attached to a recipient in a manner generally the same as (including the same as) that which would be the case during normal use thereof. An audiologist initiates a test routine associated with the hearing prostheses 400 that, among other things, permits the feedback path gain margin to be obtained (measured, estimated, etc.). An exemplary test routine can include placing the noise generator 496 in signal communication with one or more of the components of the processing section 430. In some examples, which can be separate from the process just described and/or can be utilized in combination with the process just described, sound is generated remote from the hearing prostheses 400, and ultimately presented, at least in a processed manner, to the actuator/transducer. For example, sound can be generated remote from the hearing prosthesis 400 such that it is captured by the microphones 424R and 424R, instead of noise generated by the noise generator 496. In such an example, the microphones 424R and 424L are ultimately placed into signal communication with D/A converter 439. This ultimately causes transducer 440 to transducer energy (e.g., vibrate in the case of a bone conduction device) to evoke a hearing percept corresponding to the noise captured by the microphones. In at least some instances, feedback through the physical feedback path 450 occurs. In some instances, microphone input of the hearing prosthesis can be sampled, and this sampled data can be provided to a computer that calculates the impulse response of the hearing prosthesis (e.g., by the feedback manager) and/or any other system based on the microphone input. This response corresponds to the feedback path of the device. Also, the recipient can be subjectively and/or objectively interrogated to evaluate whether a feedback induced hearing percept has been evoked. This process can be repeated (including, optionally, additional actions and/or fewer actions) where the gain of the processing section 430 is increased and/or decreased. That is, the process can be repeated in an iterative manner. By way of example, from these readings and/or from the recipient interrogation, the feedback path gain margin can be obtained.

The microphones 424R and 424L can ultimately be taken out of signal communication with D/A converter 439 when the noise generator 496 inputs a signal into the signal processing section 430. This ultimately causes transducer 440 to transducer energy (e.g., vibrate in the case of a bone conduction device) to evoke a hearing percept corresponding to the noise generated by the noise generator 496.

It is noted that in some instances, an audiologist might not be involved in the feedback path gain margin analysis. Indeed, in some instances, a hearing prosthesis can be configured to perform a self-analysis of the feedback path gain margin. It is further noted that any impulse response of the hearing prosthesis (e.g., by the feedback manager) and/or any other system that can enable the feedback path gain margin to be obtained can be utilized in at least some examples. Still further by way of example, feedback path gain margin can be obtained based on the default set by the manufacturer and/or by the provider of the hearing prosthesis to the recipient (e.g. clinic, audiologist, etc.). An example of this corresponds to utilizing a look-up table or the like to obtain the feedback path gain margin (and thus it may not be based on the actual feedback path 450). It is further noted that in at least some examples, any of these processes obtaining the feedback path gain margin can be combined with any one or more of the other processes. Any device system or method that can utilize to obtain the feedback path gain margin can be utilized in some examples.

Some various exemplary processes of obtaining the safety factor gain margin, which, as noted above, in some instances, is subtracted from the feedback path gain margin to obtain the set gain margin, will now be described.

In an exemplary scenario, the safety factor gain margin is obtained based on a traditional standard that has been found, based on empirical data, or believed, based on an abundance of redundancy, to reliably avoid a scenario where the recipient is subjected to an unacceptable amount/level of feedback influenced hearing percepts (which includes none at all) due to the potential for the feedback path to vary during the expected temporal period between one gain margin setting and a potential subsequent gain margin setting (which might be never, in which case the temporal period is the expected life of the hearing prosthesis).

An example of an unacceptable amount/level of feedback influenced hearing precept is one that prevents the effective evocation of a hearing percept during the occurrence thereof. An example of an unacceptable amount/level of the feedback influenced hearing percept is one that prevents the effective evocation of a hearing percept within one second before and/or one second after the occurrence thereof. By "effective evocation of a hearing percept," it is meant that the hearing percept is such that a typical human between 18 years old and 40 years old having a fully functioning cochlea receiving stimulation from the hearing prosthesis, where the stimulation communicates speech, would be able to understand the speech communicated by that stimulation a manner sufficient to carry on a conversation provided that those adult humans are fluent in the language forming the basis of the speech.

Still further, an example of an unacceptable amount/level of feedback influenced hearing precept is one that prevents the effective evocation of a hearing percept within 0.1, 0.2, 0.3, 0.4, 0.5, 0.6, 0.7, 0.8, 0.9, 1.0, 1.1, 1.2, 1.3, 1.4, 1.5, 1.6, 1.7, 1.8, 1.9, 2.0, 2.1, 2.2, 2.3, 2.4, 2.5 seconds and/or more or any value or range of values therebetween, in 0.01 second increments (e.g., 0.88 seconds, 0.53 to 0.92 seconds, etc.) before and/or after the occurrence thereof.

By way of example, a traditional standard based safety factor gain margin is 3-6 dB. By way of example, this traditional standard based safety factor gain margin is applied to any hearing prostheses in general and/or any hearing prostheses of types detailed above respectively in FIGS. 1A, 1B, 2A, 2B and/or 2C. That is, the safety factor gain margin that is applied is between 3 and 6 dB in at least some instances, irrespective of whether it is a percutaneous bone conduction device, an active transcutaneous bone conduction device, a passive transcutaneous bone conduction device, and/or a DACS. In some instances, this safety factor gain margin is enough to all but ensure that an unacceptable amount/level of feedback influenced hearing precept does not occur, if not ensure that any feedback does not occur, even after changes in the physical feedback path (normal changes, and not changes due to abuse of the hearing prosthesis/abusive/traumatic events, etc.).

It is noted that the above traditional based safety factor has long been recognized in the art as being less than totally efficient because it limits the set gain margin to a value below that which would otherwise avoid subjecting the recipient to an unacceptable amount/level of feedback influenced hearing percepts. That is, the redundancy of the traditional based safety factor detracts from the performance of the hearing prosthesis more than might otherwise be necessary. For example, as noted above, a higher gain margin can have, sometimes, more utilitarian value than a lower gain margin, all other things being equal. Thus, the traditional based safety factor results in a set gain margin that has less utilitarian value than might otherwise be the case. Of course, the tradeoff is that the set gain margin reliably avoids a scenario where the recipient is subjected to an unacceptable amount/level of feedback influenced hearing percepts as noted above, even when the feedback path varies during the temporal period following the gain margin setting.

An exemplary embodiment includes utilizing a safety factor gain margin that is based on a current or anticipated future state of the hearing prosthesis, and thus setting (including adjusting) the gain margin based on the current or anticipated future state of the hearing prosthesis. In an exemplary embodiment, the state of the hearing prosthesis can influence how the feedback path changes (e.g., the amount of change) over the temporal period following the gain margin setting extending to the next gain margin setting (if such exists). In some instances, there can be utility in taking into account such a state because depending on the state, set gain margin might be overly conservative or not conservative enough, thus yielding less utility than that which might otherwise be the case. For example, in some states of the hearing prosthesis, the feedback path can change relatively significantly, and thus a higher safety factor will yield utilitarian value. Conversely, in some states of the hearing prosthesis, the feedback path can change relatively insignificantly, and thus a lower safety factor will yield utilitarian value (the higher safety factor might yield less utilitarian value than the lower safety factor because the system will limit the gain, and thus the recipient will not experience as satisfying of a hearing experience as otherwise might be the case).

Figure 5:
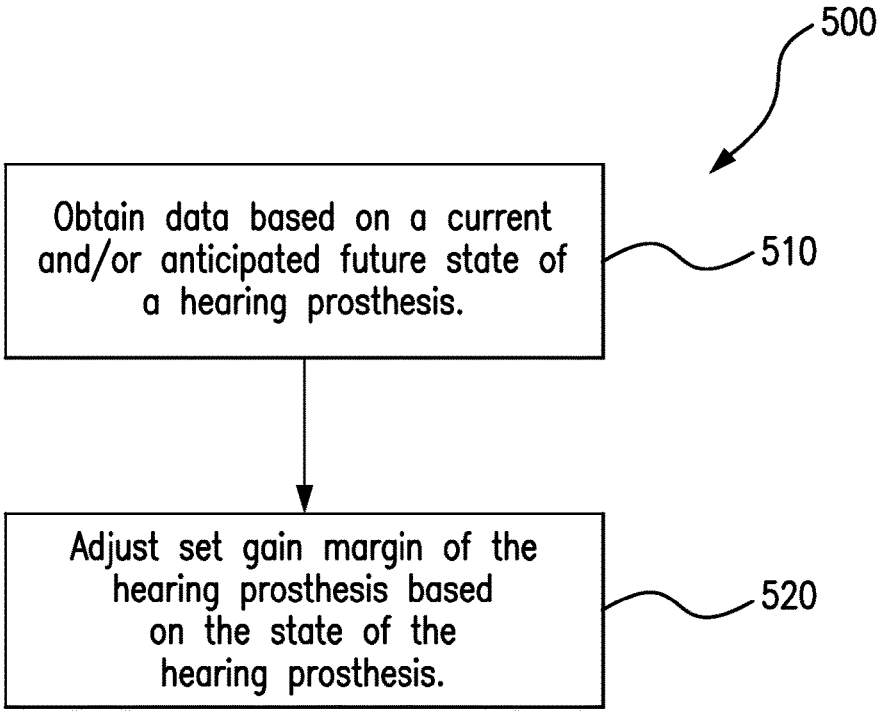
FIG. 5 is a flow chart for an exemplary method.

Accordingly, in an exemplary embodiment, referring to FIG. 5, there is a method 500 that includes action 510, which includes obtaining data based on a current and/or anticipated future state of a hearing prosthesis. It is noted that method action 510 can be performed by actually determining the current and/or anticipated future state of the hearing prosthesis, and/or by a latent variable or the like that changes with respect to a change in the state of the hearing prosthesis. That is, "data based on a current and/or anticipated future state of the hearing prosthesis" includes data from which the state can be inferred, and thus does not require that the actual state be included in the data.

Method 500 further includes method action 520, which entails adjusting the set gain margin of the hearing prosthesis based on the state of the hearing prosthesis (current and/or anticipated future state) obtained in method action 510. It is noted that in an exemplary embodiment, method 500 can be executed in an automatically and/or in an interactive manner (e.g., with a clinician and/or a recipient, etc.). It is further noted that by "based on the state of the hearing prosthesis," it is meant that the state can be known, or, alternatively, adjustments can be made based on data that changes based on state (thus, the state of the hearing prosthesis need not be determined or otherwise known). In an exemplary embodiment, a latent variable is relied on to determine how to adjust the set gain margin of the hearing prosthesis in action 520. A latent variable is a variable that is not read or analyzed directly by a system, but instead, is inferred based on other phenomena.

By the term "state," it is meant a feature related to performance that differentiates hearing prostheses within the same class, where class corresponds to the highest level of principle of operation of the hearing prosthesis. For example, one class of hearing prosthesis is a bone conduction device. Another class of hearing prosthesis is DACI. Another class of hearing prosthesis is a traditional hearing aid that basically amplifies sound impinging on the ear drum (whether it be some frequencies are all frequencies at the same and/or different amplifications). There are, of course, other classes, such as for example cochlear implants. Accordingly, it will be understood that the routine operation of a hearing prosthesis, such as, for example, signal processing associated with adaptive gain adjustment, where a feedback manager is set at a specific setting, does not change the state of the hearing prosthesis (although a change in the setting of the feedback manager would change the state of hearing prosthesis, at least depending on the setting, as will be further detailed below).

One type of state of a hearing prosthesis corresponds to a state of a connection of the hearing prosthesis, or, more particularly, to a microphone and/or output transducer bearing component of the hearing prosthesis (typically an operationally removable component) to a recipient. An exemplary embodiment associated with a bone conduction device, where the hearing prosthesis of FIG. 3 functionally corresponds to such, will now be described. In this regard, the amount of gain margin influencing change of the physical feedback path that can occur with respect to normal use of the hearing prosthesis (excluding abusive use and/or traumatic events, etc.), during the aforementioned temporal period after the gain margin is set, is different depending on whether the connection is one associated with a percutaneous bone conduction device (such as that of FIG. 1A detailed above, which can be, for example, a snap-coupling, where the unit that supports the microphone 324 and/or transducer 340 is rigidly coupled to tissue (bone) of the recipient)) or whether the connection is one associated with an active transcutaneous bone conduction device (such as that of FIG. 1B, which can be, for example, a pressure-based coupling, where the unit that supports the microphone 324 and/or transducer is flexibly coupled to tissue (skin) of the recipient). Moreover, within these types of connections, there are more specific types of connections that result in varying changes of the physical feedback path between the more specific types of connection, each of which is associated with a different state of the hearing prosthesis. For example, with respect to the percutaneous bone conduction device, whether the state of the prosthesis corresponds to a snap-coupling connection or whether the state of the prosthesis corresponds to a magnetic coupling results in varying changes of the physical feedback path over the aforementioned temporal period. Still further by example, with respect to the active transcutaneous bone conduction device, whether the state of the prosthesis corresponds to a transcutaneous magnetic connection (where, for example, the external component including the microphone(s) 324 and/or the transducer 340 is held against the skin via a transcutaneous magnetic connection—a friction based connection—with an implanted component that includes the transducer 340) or whether the state of the prosthesis corresponds to a supercutaneous mechanical connection (e.g., a so-called soft-band connection or a skin clip or the like (e.g., something that clips onto the skin)—also friction based connections—results in varying changes of the physical feedback path over the aforementioned temporal period.

Other exemplary states of the hearing prosthesis in the supercutaneous mechanical connection genus include, by way of example and not by way of limitation, a state corresponding to a test-band connection and a state corresponding to a head-band connection. Other exemplary states of the hearing prosthesis in the connection for percutaneous bone conduction devices include a state corresponding to plastic to metal coupling connection (where the skin-penetrating abutment is metal and the coupling of the operationally removable component is made of plastic, at least with respect to the portions that interface with the abutment, a state corresponding to metal to metal coupling connection), a state corresponding to a magnet to ferromagnetic coupling, a state corresponding to a magnet to magnet coupling, a state corresponding to a female abutment coupling portion coupled to a male operationally removable component coupling portion (where the male coupling portion is received in the female portion of the skin-penetrating abutment), a state corresponding to a male abutment coupling portion coupled to a female operationally removable component coupling portion (where the female coupling portion receives the male portion of the skin-penetrating abutment). In some embodiments, the state of the hearing prosthesis corresponds to a subcutaneous mechanical connection that holds the operationally removable component to the skin of the recipient. An example of such can be enabled by, for example, a metal "U" shaped structure embedded under the skin extending from the skin above the mastoid bone, across into the outer ear, and into the pinna, such that the external component is compressively received inside the "U".

It is noted at this time that the above exemplary embodiments of the states of the hearing prosthesis associated with connection type are detailed with respect to a broad connection type (e.g. percutaneous coupling) or to a specific connection type (e.g. a snap-coupling or a magnetic coupling of a percutaneous coupling). It is noted that the states of the hearing prosthesis, at least in some alternate exemplary embodiments and corresponds to a middle ground, such as for example where the state of hearing prosthesis corresponds to a state of the connection of the hearing prosthesis that corresponds to a releasable mechanical coupling (encompassing, for example, the snap-coupling and the magnetic coupling of the percutaneous bone conduction device coupling).

It is noted that by the phrase "friction based coupling," it is meant a coupling that relies on friction to at least in part hold the pertinent component of the hearing prosthesis against the recipient in a lateral direction (where the pressure that is a component of the friction holds the component in the longitudinal direction).

Also, there are additional states of hearing prosthesis respectively associated with the type of connection of the operationally removable component. Some of these additional states will now be described in the context of a DACS devices (according to FIGS. 2A-2C), where the hearing prosthesis of FIG. 3 functionally corresponds to such. It is noted that the states associated with the bone conduction devices detailed by way of example above are not necessarily mutually exclusive of the following exemplary states of the DACS devices. In some embodiments, states can be the same.

With respect to a DACS, the amount of gain margin influencing change of the physical feedback path that can occur with respect to normal use of the hearing prosthesis (excluding abusive use and/or traumatic events, etc.), during the aforementioned temporal period after the gain margin is set, is different depending on whether the connection is one associated with a so-called button sound processor, a behind the ear device (BTE device), an in the ear device (ITE device), a completely in canal device (CID device), etc. Accordingly, in an exemplary embodiment, a respective state of the hearing prosthesis corresponds to a respective state corresponding to a respective connection (of the operationally removable component supporting the microphone and/or output transducer) established via a button sound processor, a BTE device, an ITE device, a CIC device, etc.

It is noted that the states of the hearing prosthesis relating to connection type are not limited to the aforementioned types. Other states can correspond to other connection types. In some exemplary embodiments, the gain can be set based on any state relating to any type of connection providing the teachings detailed herein and/or variations thereof can be practiced.

As will be further described below, there is utilitarian value in basing the set gain margin on the state and/or potential future state of the hearing prosthesis instead of setting it based on a safety factor gain margin that is the same irrespective of state(s). For example, the recipient can take better advantage of the full potential of the hearing prosthesis and/or can avoid and/or mitigate or otherwise decrease the relative likelihood (relative to a non-state based set gain) where the hearing percept is based upon an under amplified signal(s). It is further noted that in at least some embodiments, the opposite can be the case. That is, the scenario where an unacceptable amount/level of feedback influenced hearing precept occurs can be avoided and/or mitigated or otherwise the likelihood of such occurring is relatively reduced (relative to a non-state based set gain). In this regard, there can be the possibility that the traditionally based safety factor gain margin does not account for all possible feedback scenarios. An example of why such may be the case sounds in statistics. For example, when a conclusion is based on a sampling of a heterogeneous population, and the conclusion is applied to all members of that heterogeneous population, likelihood that conclusion does not apply to all members (if only a black swan event) is higher relative to the situation where the heterogeneous population is broken up into more homogeneous subpopulations and a plurality of respective conclusions are developed for each of the subpopulations (if only because the likelihood or possibility of a black swan event occurring is relatively reduced).

Some exemplary embodiments where the gain margin of hearing prosthesis is set and/or otherwise adjusted based on the current or anticipated future state of hearing prosthesis as it relates to states of connection of the hearing prosthesis recipient have utility in that such can account for the fact that these connections have different feedback path characteristics which impact the feedback path gain margin of hearing prostheses, both with respect to the near term current feedback path and with respect to a long term future feedback path. In this regard, in some exemplary embodiments, the gain margin is set based on the current or anticipated future state of hearing prostheses (i.e., the state of the connection of the hearing prosthesis) and also based on temporal factors that relate to that state.

For example, with respect to a near term current feedback path, a friction based connection utilizing a transcutaneous magnetic coupling may have a feedback path that can have a variance of, for example, 5 dBs, depending on, for example, the hydration and/or saline level of the recipient, the atmospheric pressure, etc. Conversely, a percutaneous mechanical connection of a percutaneous bone conduction device utilizing a snap coupling may have a feedback path that can have a variance of, for example 2 or 3 dBs. Accordingly, by basing the safety factor gain margin on the connection state, the set gain margin can be set higher in the case of the latter state, at least when setting the gain for the near term. This can, for example result in increased amplification of the signal than otherwise might be the case, at least with respect to the latter state, while still avoiding the occurrence of an unacceptable amount/level of feedback influenced hearing precept, at least in the near term.

Still further by way of example, with respect to a long term future feedback path, a friction based connection utilizing a transcutaneous magnetic coupling may have a feedback path that can have a variance of, for example, 6 dBs over a number of years (such as the aforementioned period between gain margin settings), which is only a slightly greater variation in the aforementioned near-term current feedback path variation. Conversely, a percutaneous mechanical connection of a percutaneous bone conduction device utilizing a snap coupling may have a feedback path that can have a variance of, for example 10 dBs over a number of years (such as the period between coupling component replacement, or the aforementioned period between gain margin settings). Accordingly, by basing the safety factor gain margin on the connection state, the set gain margin can be set higher in the case of the former state when setting the gain for the long term. This can, for example result in increased amplification of the signal than otherwise might be the case, at least with respect to the former state, while still avoiding the occurrence of an unacceptable amount/level of feedback influenced hearing precept, in the long term.

Interests of completeness, while the above examples provide respective connection states where the feedback variance in the near term is relatively minimal and relatively moderate, respectively, and where the feedback variance long-term is relatively moderate and relatively minimal, respectively, an example of a connection state where the feedback variance in both the near term and long term is relatively high will now be provide. An example of such is the soft band connection state, where the feedback variance can be about 15 dB in both the near term and the long term, with a variance can be driven primarily, for example, by different positioning of the soft band (or more particularly, different positioning of the operationally removable component of the hearing prosthesis only to the imprecise nature of the soul and connection, where the long-term variation is generally the same as the short-term variation because the recipient can control the tightness of the soft band).

View of the above, an exemplary embodiment includes setting a gain margin of hearing prosthesis based on current or anticipated future states of connection of the hearing prosthesis, and further based on a temporal factor related to the state of connection. For example, in the case of the percutaneous bone conduction device snap coupling, if it is anticipated (including planed) that the recipient will have a wear component of the snap coupling replaced at the end of the near term temporal periods or shortly thereafter, the gain margin can be set based on the connection state and based on the temporal factor associated with generally non-worn snap coupling. By way of example only and not by way of limitation, with respect to the examples above, the safety factor gain margin can be set to accommodate a variation of 2 dBs, and thus the gain margin is set accordingly. Conversely, still with respect to the case of the percutaneous bone conduction device snap coupling, if it is anticipated (including planed) that the recipient will only have a wear component of the snap coupling replaced after the end of the near term temporal periods, such as at the end of the long term temporal periods (e.g., when the coupling no longer reliably couples the operationally removable component to the abutment), the gain margin can be set based on the connection state and based on the temporal factor associated with generally very worn snap coupling. By way of example only and not by way of limitation, with respect to the examples above, the safety factor gain margin can be set to accommodate a variation of 10 dBs, and thus the gain margin is set accordingly.

Another exemplary state of a hearing prosthesis is a state of a feature setting of the hearing prostheses. In particular, certain feature settings can affect the feedback performance of a hearing prosthesis. By way of example only and not by way of limitation, certain feature settings can actually prevent or otherwise reduce the likelihood of the occurrence of an unacceptable amount/level of feedback influenced hearing precept (e.g., limiting the effects of feedback such that only an acceptable amount/level of feedback influenced hearing percept occurs and/or preventing even the occurrence of an acceptable amount/level of feedback influenced hearing percept). For such feature settings, the safety factor gain margin can be lower than that which it otherwise might be in the absence of the feature setting. Indeed, in some embodiments, the safety factor gain margin could be a negative margin. That is, because the safety factor gain margin is subtracted from the feedback path gain margin, a negative safety factor would increase the set gain margin. Conversely, some feature settings can function in an opposite manner. By way of example only and not by way of limitation, certain feature settings can increase the occurrence of an unacceptable amount/level of feedback influenced hearing precept (e.g., limiting the effects of feedback such that only an acceptable amount/level of feedback influenced hearing percept occurs and/or preventing even the occurrence of an acceptable amount/level of feedback influenced hearing percept). For such feature settings, the safety factor gain margin is higher than that which it otherwise might be in the absence of the feature setting.

With respect to a more specific example, a state of the hearing prosthesis where the state of the feature setting of the hearing prosthesis is a state that includes so-called beam forming and/or directional sound sensing (where sound coming from one direction, usually in front of the recipient, is amplified relative to other sounds), the beam forming and/or directional sound sensing can, in at least some instances, prevent or otherwise reduce the likelihood of the occurrence of an unacceptable amount/level of feedback influenced hearing precept. In an exemplary embodiment, if the feedback is received by two or more microphones of the hearing prosthesis (at least where the microphones are supported by the same unit/platform (e.g., as in a button sound processor or an external component of a bone conduction device)) in a substantially simultaneous temporal manner, the hearing prosthesis, when in the beam forming state and/or in the directional sound sensing state, will attenuate at least in part the feedback input via the beam forming algorithm/directional sound sensing algorithm, thus permitting the set gain margin to be higher than it otherwise would be. However, it is noted that in an alternative embodiment, at least at some frequencies, these states result in increased feedback, thus creating a scenario where there is utilitarian value in lowering the set gain margin to a level that it otherwise would be. Such a scenario can occur in the eventuality that there are frequencies of the signals from the two or more microphones of the beam forming, etc., system, that are in phase when multiplexed.

Alternatively and/or in addition to this, the gain margin of hearing prosthesis that is set based on the current and/or anticipated future state of the hearing prosthesis can be set on a frequency related basis. For example, the gain margin can be set based on a state of the hearing prosthesis in which hearing prosthesis is actively beam forming and/or actively directionally sensing sound (where, in an embodiment, the this changes how sounds are picked up or otherwise captured), where the gain margin is set such that the gain margin for one or more lower frequency bands (e.g., those corresponding to voice) is higher than the gain margin for one or more higher frequency bands, where the frequency bands correspond to subsets of frequency bands of the hearing prosthesis. It is noted while the embodiment where a set gain margin is different for different frequencies is discussed with respect to feature settings, in other embodiments, the set gain margin be different for different frequencies with respect to the connection type of the external component to the recipient, etc.

Still further by way of example, the feature setting of the hearing prosthesis can include a sound classifier that classifies sound one or more categories (e.g., voice, music, background noise, etc.). The gain margin on the hearing prosthesis, in total or on a frequency independent basis, can be set based on output of the sound classifier (based on the classification of the sound classified by the sound classified).

Alternatively or in addition to this, a state of the hearing prosthesis where a compression algorithm and/or a noise reduction algorithm is activated can prevent or otherwise reduce the likelihood of the occurrence of an unacceptable amount/level of feedback influenced hearing precept, or, alternatively, can cause or otherwise increase the likelihood of the occurrence of an unacceptable amount/level of feedback influenced hearing precept. Still further, in some embodiments, a state of the hearing prosthesis where a feedback reduction algorithm is engaged can also prevent, reduce, cause and/or increase the likelihood of the occurrence of an unacceptable amount/level of feedback influenced hearing precept. In this regard, the state of the hearing prosthesis can change based on the activation or deactivation of a feedback manager and/or a change of setting of a feedback manager (typically where the feedback manager is already active). Accordingly, in an exemplary embodiment, there are devices systems and/or methods of setting or otherwise adjusting the gain margin of hearing prosthesis based on whether a compression algorithm and/or a noise reduction algorithm is actively, and/or based on the setting of the compression out of the room and/or noise reduction.

It is noted that the aforementioned feature settings correspond to a state of the hearing prosthesis when those settings are activated, and not just because the hearing prosthesis has that capability. That is, if the feature setting is not active, it will not influence or otherwise impact feedback influenced hearing percepts, and thus does not impact state of hearing prosthesis. Is further noted that the state of hearing prosthesis can vary by adjustment of settings of the feature settings. For example, a hearing prosthesis can be in one state when set to a first set setting of a beam forming system (e.g., a setting that concentrates the focus of the beams at a given area irrespective of how a recipient moves his or her head) can be in another state when set to a second setting of a beam forming system (e.g., a setting that concentrates the focus of the beams wherever the recipient is facing). Accordingly, in an exemplary embodiment, there is a device, system and/or method that adjusts or otherwise sets the gain margin of a hearing prosthesis based on a change of setting of a feature setting (typically, a feature setting that is already active at the time of the change of the setting).

In at least some embodiments, the state of the hearing prosthesis is different depending on whether the sound input to the hearing prosthesis is conveyed via an electronic signal (audio streaming from, for example, a portable music playing device (MP3 player, etc.) that is "plugged in" to the hearing prosthesis) or via the microphones thereof.

In some embodiments, the state of the hearing prosthesis is different depending on how aggressive the feedback cancellation system (sometimes referred to as feedback manager) is set to cancel feedback. In some hearing prostheses, and option is afforded to the recipient to adjust, for example in the manual manner, the aggressiveness of the feedback cancellation system. Some embodiments provide the recipient with the option of setting the feedback cancellation system to a moderate setting, to a strong setting or to turn feedback cancellation off entirely. Some embodiments provide additional intermediate settings (e.g. low, moderate, medium strong, strong, etc.). In some embodiments, the state of the hearing prosthesis changes based on the setting that the recipient sets with respect to the feedback cancellation setting.

It is noted that in some embodiments, the various features that influence the state of the hearing prosthesis can be applied simultaneously such that the state of the hearing prosthesis is a hybrid of the two states. In an exemplary embodiment, the state of a beam forming system in the state of the feedback cancellation system can overlap. For example in an exemplary embodiment, the state of the hearing prosthesis can correspond to an omnidirectional sound capture setting and a moderate feedback reduction setting. Alternatively, the state of the hearing prosthesis can correspond to a fixed direction sound capture setting with no feedback reduction setting. Still further, the state of the hearing prosthesis can correspond to an automatic direction sound capture setting with a strong feedback reduction setting. The safety factor gain margin can be different for each of these states. The below table provides exemplary data for safety factor gain margin values (in dBs) for various frequencies of a hearing prosthesis in nine different states corresponding to the directionality sound capture setting and the feedback reduction setting.

| | Freq (Hz) | | | | | | | |
|---|---|---|---|---|---|---|---|---|
| Setting: | 250-1350 | 1700 | 2190 | 2700 | 3650 | 4500 | 5900 | 7500 |
| Omnidirectional (OD) No Feedback Reduction (FBR) | −9 | −9 | −9 | −9 | −9 | −9 | −9 | −9 |
| Fixed Direction (FD), No FBR | 0 | 0 | −2 | −3 | −4 | −5 | −7 | −8 |
| Automatic Direction (AD), No FBR | 4 | 3 | 2 | 1 | −1 | −2 | −3 | −5 |
| OD, FBR Moderate | −3 | −3 | −2 | −2 | −2 | −2 | −2 | −5 |
| FD, FBR Moderate | −2 | −2 | −3 | −3 | −4 | −4 | −5 | −6 |
| AD, FBR Moderate | 3 | 3 | 2 | 2 | 1 | 1 | −1 | −2 |
| OD, FBR Strong | 2 | 2 | 2 | 2 | 2 | 2 | 2 | −1 |
| FD, FBR Strong | 1 | 0 | −1 | −2 | −3 | −4 | −5 | −6 |
| AD, FBR Strong | 8 | 8 | 7 | 7 | 5 | 4 | 4 | 1 |

It is noted that the above values are exemplary. In other embodiments, other values can be present. That said in an exemplary embodiment, where, for example, the feedback path gain margin is identified as 28 dBs, for a state of the hearing prosthesis where the directionality sound capture setting is set to fixed directionality and the feedback reduction setting is set to moderate, the set gain margin will correspond to 26 dBs for frequencies between 250 and 1600 Hz.

Figure 6:
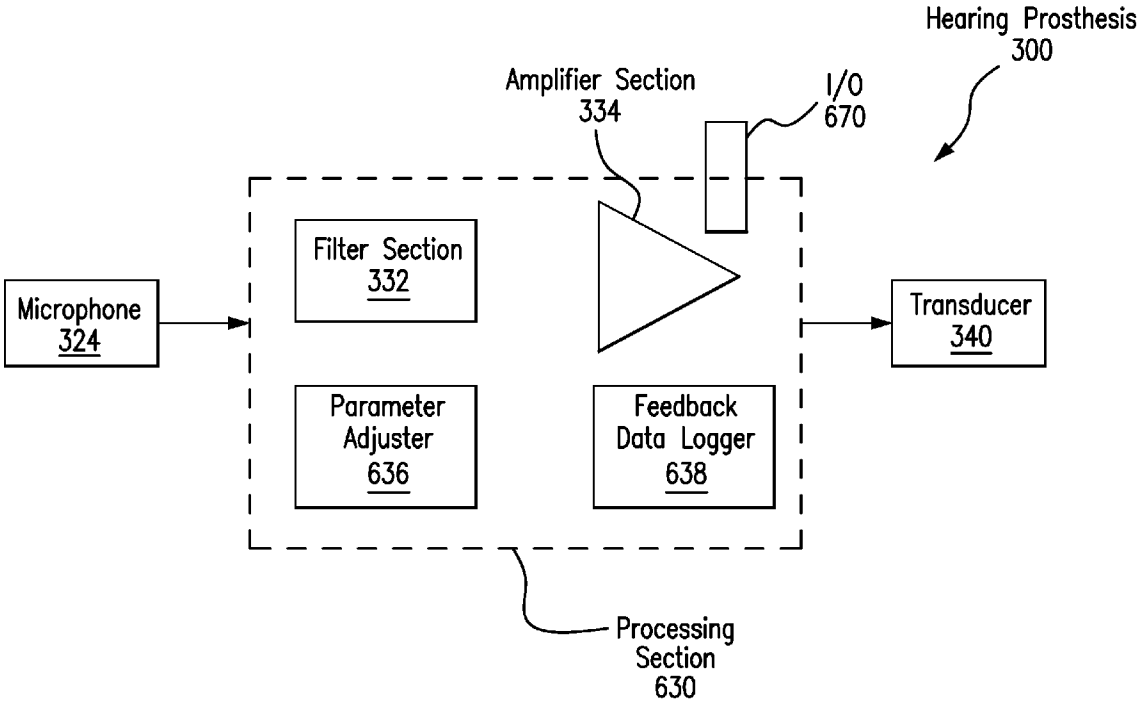
FIG. 6 is a functional diagraph of an embodiment of the hearing prosthesis of FIG. 3.

Referring to FIG. 6, a hearing prosthesis 600 is presented that can be utilized to practice some and/or all of the methods detailed herein and/or variations thereof, with like numbers corresponding to that of FIG. 3. As can be seen, processing section 630 includes filter section 332 and amplifier section 334, as with hearing prosthesis 300 detailed above. Processing section 630 also includes a parameter adjuster 636, which, in an exemplary embodiment, is configured to adjust the set gain margin of the hearing prosthesis 600 (automatically and/or in response to input through I/O block 670) based on a current or anticipated future state of the hearing prosthesis. In an exemplary embodiment, parameter adjuster 636 can be configured to obtain data based on a current and/or future state of the hearing prosthesis (e.g., execute method action 510), in accordance to any of the exemplary ways detailed herein and/or variations thereof, automatically and/or via input of such through I/O block 670. That is, it can be configured to detect latent variables associated with the performance of the hearing prosthesis and/or use those variables (which might be fed into the prosthesis 600 via I/O block 670 instead) adjust the set gain margin (which would be adjustment based on the current or anticipated future state of the hearing prosthesis). I/O block 670 can be used to control parameter adjuster 636 to adjust the set gain margin (in which case method 500 can be executed externally of the hearing prosthesis 600). I/O block 670 can communicate with fitting software or the like, such as software on a personal computer of an audiologist, so that the system (fitting computer and prosthesis 600) can be utilized to execute one or more or all of the method actions detailed herein an/or variations thereof.

In an exemplary embodiment, prosthesis 600 and/or variations thereof can be configured to execute one or more or all of the method actions detailed herein and/or variations thereof.

It is noted that hearing prosthesis 600 includes additional components, such as feedback data logger 638, that will be discussed further below.

To summarize, not in an exhaustive manner, exemplary embodiments can include a method that includes obtaining access to a hearing prosthesis (which includes placing the hearing prosthesis on one's self and/or placing the hearing prosthesis on another person, communicating with one in a manner beyond that which would be associated with mere use of the hearing prosthesis (e.g., via electrical signal communication or the like), and/or any other action that enables the rest of the method to be executed, etc.), and setting or otherwise adjusting a gain margin of hearing prosthesis based on a current or anticipated future state of the hearing prosthesis, where the state of the hearing prosthesis corresponds to any one or more of those detailed herein and/or variations thereof, including species of one or more states, species of species of one or more states, etc. Further, an exemplary embodiment includes any device and/or system configured to enable practice one or more of these method actions, such as a device and/or system configured to enable adjustment of the gain margin of hearing prosthesis based on a current or anticipated future state the hearing prosthesis, including any device and/or system configured to do so in total and/or at least in part automatically and or semiautomatic (where automatically and/or semiautomatically include situations where a user must initiate the method some manner). In an exemplary embodiment, this device and/or system can be included in the processing section 330 of the hearing prosthesis of FIG. 3 (e.g., the processing section 330 can be configured to execute the methods, etc.) and/or can be a separate part of the hearing prosthesis. Also it is noted that the state detailed herein and/or variations thereof are merely exemplary, and in some embodiments, the gain adjustment/gain setting is based on other states alone and/or in addition to the states detailed herein and/or variations thereof.

In an exemplary embodiment, there is a method where a recipient experiences feedback, and the recipient activates a data logging system to indicate that he/she experienced the feedback. For example, the activation can create a temporal marker that enables a healthcare professional or the like to identify where, temporally, data recorded by the hearing prosthesis is of interest with respect to the feedback event. The healthcare professional can then use this data to further adjust the set gain margin, at least with respect to the given scenario that gave rise to the feedback event. By way of example, a recipient might send a message with a portable electronic communication device (e.g., a cell phone, etc.), that is logged by a healthcare professional. Alternatively or in addition to this, a recipient can activate a component on the hearing prosthesis that creates the temporal marker. In alternate embodiments, the recipient can write down the approximate time of the feedback experience and supply the time to a healthcare professional at a later date.

In an alternate embodiment, the hearing prosthesis can have functionality akin to an aircraft "black box," where data is recorded but then overwritten during subsequent activities because it has been deemed that the prior recorded data is not useful (e.g., the aircraft did not crash). In an exemplary embodiment, the recipient can activate the data logging system when he or she experiences feedback, and this will prevent the data from being overwritten by subsequent data. For example, over a period of weeks or months, the recipient might activate the data logging feature two, three, four, five, six or more times, and each event would be preserved in the memory of the hearing prosthesis. This preserved data would then be provided to a healthcare professional for analysis and subsequent adjustment of the set gain margin.

An alternate embodiment, the aforementioned methods can optionally further include the action of determining the feedback path gain margin according to one or more of the methods or otherwise ways of doing so detailed herein and/or variations thereof, where determining includes actual measurement as well as estimates and or utilizing data based on empirical and/or theoretical results (e.g., manufacturer provided information on feedback path gain margins, etc.). Accordingly, an exemplary embodiment includes a method according to any of those detailed herein and or variations thereof that further includes reading or otherwise obtaining that from the feedback cancellation filter coefficients during a test of the feedback cancellation system, such as by way of example one that is performed during a fitting session of the hearing prosthesis.

An exemplary embodiment includes adjusting a parameter of the hearing prosthesis in response to a change in the feedback path, such as the physical feedback path, of the hearing prosthesis. Briefly, with reference to FIG. 6, in an exemplary embodiment, parameter adjuster 636 of prosthesis 600 is utilized to adjust the parameters as will be detailed herein and/or variations theoref. This can be done automatically and/or based on input from I/O block 670.

Figure 7:
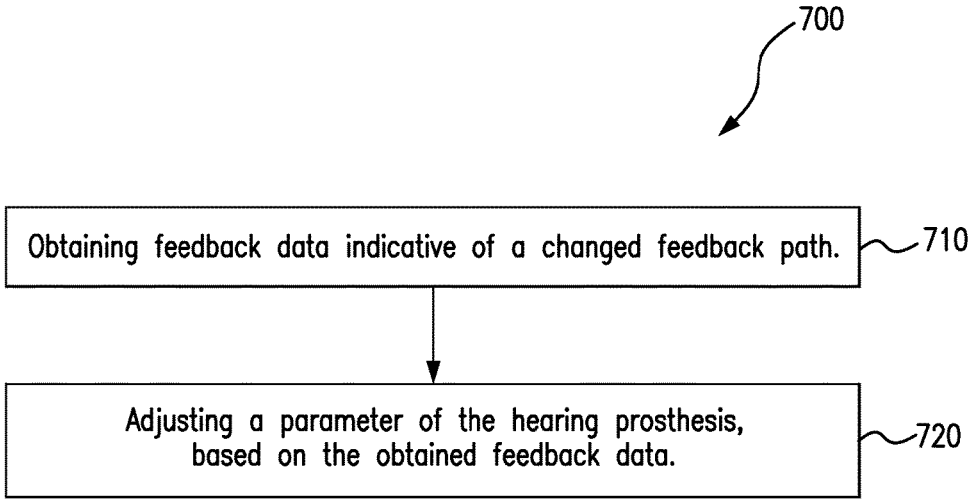
FIG. 7 is a flow chart for another exemplary method.

More particularly, in an exemplary embodiment, with reference to FIG. 7, there is a method 700 that includes action 710 that entails obtaining feedback data indicative of a changed feedback path of a hearing prosthesis used by a recipient. In an exemplary embodiment, action 710 is performed automatically by, for example, the hearing prosthesis itself. In an exemplary embodiment, a hearing prosthesis can have a system that records data related to feedback. Alternatively or in addition to this, data related to the summation device 435 can be obtained. The data can be recorded onboard the hearing prosthesis 400 and/or can be communicated to a remote device. This data can be paired, in a temporal manner, together and/or with other data (e.g. such as data logged by the recipient himself or herself relating to for example, the environment in which the recipient was utilizing the hearing prosthesis (e.g. rock concert, commercial airline flight, performing in a marathon, etc.)). Additional examples of such data can be obtained detailed below by way of example. Any data that can be utilized to practice the teachings detailed herein and/or variations thereof can be obtained or otherwise paired with the aforementioned in some embodiments. Any method of data logging relating to feedback data can be utilized in some embodiments. Any device or system that can enable such methods of logging can be utilized in some embodiments.

The method further includes action 720, which entails adjusting a parameter of the hearing prosthesis based on the obtained feedback data. In an exemplary embodiment, the adjusted parameter is a feedback influenceable parameter. That is, a parameter that influences the feedback performance of a hearing prosthesis, increasing and/or decreasing the likelihood of the occurrence of an unacceptable amount/level of feedback influenced hearing percept for a given use scenario. In an exemplary embodiment, the feedback influenceable parameter is the gain margin of the hearing prosthesis. Some additional feedback influenceable parameters can be adjusted according to action 720 are detailed below by way of example.

In some exemplary methods, feedback data indicative of a changed feedback path that can be obtained includes data based on the adaptive part of a feedback cancellation system. In this regard, the filters of the feedback cancellation system represent the physical feedback path (e.g., physical feedback path 430 with respect to FIG. 4). That is, as the feedback path 430 changes, the feedback cancellation system of the hearing prosthesis 400 automatically adjusts to compensate for this changed feedback path. This adjustment is typically in the form of real-time changes to the filter coefficients of filter 494. However, in some embodiments, the feedback cancellation system also includes a "learning part" that evaluates the real-time changes to the filter coefficients (either by directly reading this filter coefficients and/or by inferring changes to those filter coefficients, such as, by way of example, based on the output of the least mean squares block 495) over a period of time, and based on these changes over that period of time, adjusts the feedback cancellation system (in an exemplary embodiment, the pre-filters 493 are adjusted based on these changes, the rate of change of the filter coefficients (how fast they are changed in response to a change—the "speed of adaptation," or the "adaptation time") is adjusted, and/or the amount of change of the filter coefficients (how much the coefficients are changed in response to a change—the "quantity of adaptation") is adjusted. The former is referred to as the fast adaptive part of the feedback cancellation system, and the latter (the learning part) is referred to as the slow learning part of the feedback cancellation system. In an exemplary embodiment, the obtained feedback data indicative of a changed feedback path is data relating to the fast adaptive part, while in an alternative embodiment the obtained feedback data indicative of a changed feedback path is data relating to the slow learning part. In yet an alternative embodiment, the obtained feedback data indicative of the changed feedback path is a combination of the two.

In an exemplary embodiment, the changed feedback path pertaining to the obtained feedback data indicative of that changed feedback path is a feedback path that changed because of a change associated with a given connection type. For example, a bone conduction device utilizing the soft band connection detailed above will have a feedback path that varies in a significant manner over a period of days, if not potentially hours. Conversely a bone conduction device utilizing a snap coupling connection as detailed above will have a feedback path that varies in a significant manner over months, if not years. Alternatively or in addition to this, by way of example, the changed feedback path is one that changed due to temperature and/or humidity and/or a physiological condition of the recipient (saline content of body fluids, a level of hydration, blood pressure, sweating, etc.). Still further by way of example, the changed feedback path can be one that changes with respect to some frequencies but not with respect to other frequencies. For example, with respect to the percutaneous bone conduction device, the feedback path is relatively static for low frequencies, but can change relatively substantially for higher frequencies. It is noted, however, that sometimes, the feedback path can drastically change for even low frequencies, such as in the scenario where the removable component is dropped on the ground, etc. Also, the feedback path for low frequencies can change over time, such as due to abutment/connector wear, etc., and this change can take months or years to manifest a significant change. It is noted that the obtained feedback data can be based on frequency responses and/or impulse responses of the hearing prosthesis and/or another system. In an exemplary embodiment, the obtained feedback data constitutes temporally varying frequency responses and/or temporally varying impulse responses. That is, the data can reveal how the responses vary with time.

Some exemplary embodiments of the adjusted parameter adjusted in action 720 of method 700 will now be described. As noted above, in an exemplary embodiment, the adjusted parameter that is adjusted based on the obtained feedback data obtained in method action 710 is the gain margin of a hearing prosthesis. That is, the gain margin of the hearing prosthesis is set based on the obtained feedback. In an exemplary embodiment, it can be the feedback path gain margin that is adjusted, while in other embodiments, it can be the safety factor gain margin that is adjusted, while in other embodiments can be another component of that equation that results in the set gain margin. Any adjustment that results in the set gain margin of hearing prosthesis being adjusted can be utilized in some embodiments. In some exemplary embodiments, the feedback path gain margin component is adjusted to address a semipermanent and/or permanent change in the physical feedback path 430 identified as a result of the obtained feedback data. In some exemplary embodiments, the safety factor gain margin component is adjusted to "fine-tune" the hearing prosthesis based on observations from the obtained feedback data. For example, the observation can be that the changes in the feedback path are such that the safety factor can be adjusted to account for these changes so as to prevent or otherwise reduce the likelihood of the occurrence of an unacceptable amount/level of feedback influenced hearing precept in the future.

In some exemplary embodiments, the parameter adjusted in action 720 is a "speed of adaptation," of the gain cancellation system of the hearing prosthesis (sometimes refers to as the adaptation time of the gain cancellation system). For example, with reference to FIG. 4, as noted above, least mean squares block 495 changes the filter coefficients of filter 494 based on input from amplifier 434 and input from pre-filter 493. The speed at which the filter coefficients are changed from a previous setting is buried in some embodiments based on the obtained feedback data from action 710. By way of example only and not by way of limitation, in some embodiments, the filter coefficients of filter 494 are updated every millisecond, which shall be defined herein as a fast filter coefficient update speed, based on the data obtained in method action 710 corresponding to a first feedback path regime. However, if the data obtained in method action 710 is indicative of a second feedback path regime that is effectively different from the first feedback path regime, the filter coefficients of filter 494 are updated every 2 milliseconds. Still further by way of example, if the data obtained in method action 710 is indicative of a third feedback path regime that is effectively very different from the first or second feedback path regime, the filter coefficients of filter 494 are updated every 20 milliseconds. This latter update time shall be defined herein as a slow filter coefficient update speed. An example of a changed feedback path that could result in the aforementioned changes from the fast filter coefficient update speed to a slower coefficient update speed (not necessarily including the slow coefficient update speed) could be that which results from the recipient placing a hat on his or her head/removing a hat from his or her head. In an exemplary embodiment, the update time of the filters could be varied from, for example, about 0.1 milliseconds, about 0.2 ms, about 0.3 ms, about 0.4 ms, about 0.5 ms, about 0.6 ms, about 0.7 ms, about 0.8 ms, about 0.9 ms, about 1.0 ms, about 1.1 ms, about 1.2 ms, about 1.3 ms, about 1.4 ms, about 1.5 ms, about 1.6 m is, about 1.7 ms, 1.8 ms, about 1.9 ms, about 2.0 ms, about 2.5 ms, about three ms, about 3.5 ms, about four ms, about 4.5 ms, about five ms, about six ms, about seven ms, about eight ms, about nine ms, about 10 ms, about 11 ms, about 12 ms, about 13 ms, about 14 ms, about 15 ms, 16 ms, that 17 ms, about 18 ms, about 19 ms, about 20 ms, 21 ms, about 22 ms, about 23 ms, about 24 ms, about 25 ms, about 26 ms, 27 ms, about 28 ms, about 29 ms, about 30 ms, or more or about any value or range of values therebetween in 0.05 ms increments (for example, about 0.85 ms, about 1.75 ms, about 1.35 ms to about 1.25 ms, etc.)

In an alternative embodiment, separately and/or in addition to any of the above detailed embodiments, the quantity of adaptation in the parameter of the hearing prosthesis is adjusted based on the obtained feedback data obtained in method action 710. By way of example only and not by way of limitation, in some embodiments, the filter coefficients of filter 494 are changed by an amount that does not exceed a quantifiable number, such as, for example, 5% (of the total number of coefficients changed, or a total change of all of the coefficients, etc.), which shall be defined herein as a small filter coefficient update quantity, based on the data obtained in method action 710 corresponding to a fourth feedback path regime (which might correspond to one or more of the first, second or third offer mentioned feedback regimes). However, if the data obtained in method action 710 is indicative of a fifth feedback path regime (which might correspond to one or more of the other of the first, second or third offer mentioned feedback regimes) that is effectively different from the fourth feedback path regime, the filter coefficients of filter 494 are changed by an amount that does not exceed a quantifiable number, such as, for example, 10% (of the total number of coefficients changed, or a total change of all of the coefficients, etc.). Still further by way of example, if the data obtained in method action 710 is indicative of a sixth feedback path regime (that might correspond to the other of the first, second, or third after mentioned feedback regimes) that is effectively very different from the fourth or fifth feedback path regime, the filter coefficients of filter 494 are changed by an amount that does not exceed a quantifiable number, such as, for example, 33% (of the total number of coefficients changed, or a total change of all of the coefficients, etc.), which shall be defined herein as a large filter coefficient update quantity An example of a changed feedback path that could result in the aforementioned changes from the small filter coefficient update quantity to a larger coefficient update quantity (not necessarily including the large coefficient update quantity) could be that which results from the recipient placing a hat on his or her head/removing the hat from his or her head.

As noted above, some feedback cancellation systems include a slow learning part. In an exemplary embodiment, the speed at which changes to the feedback cancellation system are implemented as a result of the "learning" is varied based on the obtained feedback data from method action 710. In an exemplary embodiment, as referenced above, the learning part of the feedback cancellation system can be implemented via pre-filters 493, at least if they are adaptive filters or filters that are variable in some manner (although in some embodiments the filters could be replaceable filters where method action 720 corresponds to replacing the filters based on the data obtained in method 710). In an exemplary embodiment, the speed at which changes to the feedback cancellation system are implemented as result of learning can be varied from, for example about 10 seconds, about 15 seconds, about 20 seconds, about 30 seconds, about 45 seconds, about 1 minute, about 2 minutes, about 3 minutes, about 4 minutes, about 5 minutes, about 6 minutes, about 7 minutes, about 8 minutes, about 9 minutes, about 10 minutes, about 20 minutes, about 30 minutes, about 45 minutes, about one hour, about 1.5 hours, about 2 hours, about 2.5 hours, about 3 hours, about 4 hours, about 5 hours, about 6 hours, about 7 hours, about 8 hours, about 12 hours, about 16 hours, about 24 hours, about 1.5 days, about 2 days, about 2.5 days, about 3 days, about 4 days, about 5 days, about 1 week, about 1.5 weeks, about 2 weeks, about 2.5 weeks, about 3 weeks, about 4 weeks, about 5 weeks, about 6 weeks, about 7 weeks, about 2 months, about 2.5 months, about 3 months, about 4 months or more or any value or range of value there between in increments of about one half of a minute (e.g., about 15.5 minutes, about 5.4 hours, about 4 hours to about 13.3 hours, etc.).

In an exemplary embodiment, separately and/or in addition to any of the above detailed embodiments, it is the quantity of the changes relating to the learning part that is adjusted based on the obtained feedback data obtained in method action 710.

In some exemplary embodiments, the parameter adjusted in action 720 is a pre-filter setting and/or settings of the feedback cancellation system of the hearing prosthesis. Alternatively or in addition to this, the parameter adjusted in action 720 is a parameter relating to the mixer 435 that varies how the signals are mixed.

It is noted that the parameters can be adjusted, in some embodiments, on a frequency dependent basis. For example, the set gain margin can be set to have different gain margins for different frequency bands within the frequency spectrum of the hearing prostheses. Indeed in an exemplary embodiment, action 720 entails adjusting some parameters and not other parameters based on the obtained feedback data obtained in action 710.

Still further, in an exemplary embodiment, the parameter that is adjusted corresponds to a volume control. For example, the gain associated with specific frequencies can be adjusted on a frequency-based manner. For example, the volume control can be adjusted such that some frequencies are limited with respect to upward gain, while other frequencies are less limited ore more limited (if at all) with respect to upward gain.

In some embodiments, the parameter that is adjusted is the feature setting itself. By way of example a feature setting can be disabled in some embodiments based on the obtained feedback data indicative of a changed feedback path.

Other parameters can be adjusted as well based on the obtained feedback data in method action 710. Any parameter that can be adjusted that can enable the teachings detailed herein and/or variations thereof to be practiced can be varied in method action 720 in some embodiments.

Is noted that in some embodiments, method 700 does not include method 720. That is, in an exemplary embodiment, there is a method that entails obtaining feedback data indicative of a changed feedback path of the hearing prosthesis used by a recipient. In such an exemplary embodiment, the method can entail analyzing the obtained feedback data indicative of a changed feedback path and identifying a parameter of the hearing prosthesis where adjustment of that parameter will or can yield utilitarian value. In an exemplary embodiment, the method can entail, alternatively or in addition to this, providing a suggestion as to the adjustments of the parameter that will or can yield utilitarian value. By way of example only and not by way of limitation, in an exemplary embodiment, the method can entail suggesting or otherwise identifying a recommended set gain margin that the hearing prosthesis should be set to based on the obtained feedback data indicative of a changed feedback path, such that the identified recommended set gain margin (or other parameter(s)) are conveyed in such a manner that action can be taken based on this recommendation. For example, a hearing prosthesis may include a data module that records feedback data indicative of the changed feedback path. A data interface may be provided with the hearing prosthesis (e.g. USB port) such that this data can be downloaded or otherwise conveyed to, for example an audiologist or other healthcare professional, such as one that could adjust the set gain of the hearing prosthesis.

In a variation of this alternate embodiment, the hearing prosthesis can be configured such that it automatically adjusts the parameter based on the obtained feedback data. Along these lines, it is noted that any one or more or all of the method actions detailed herein and/or variations thereof can be practiced and or automated fashion in at least some embodiments. Corollary to this is that in some exemplary embodiments, there is a hearing prosthesis that is configured to automatically adjust the parameters based on the obtained feedback data. Alternatively and/or in addition to this, an external device (such as a personal computer configured with fitting software) can use this obtained feedback data indicative of a changed feedback path to adjusts one or more parameters and/or to recommend or otherwise indicate an adjustment of one or more parameters, where such adjustment can have utilitarian value.

In some embodiments, the action of analyzing the obtained feedback might not be executed. In some exemplary embodiments of these alternate methods and/or in addition to the method actions of method 700, there is the action of operating the hearing prosthesis to evoke a hearing percept, where the operation of the hearing prosthesis results in the generation of the data indicative of a changed feedback path that is obtained during method action 710. It is noted that in some embodiments, the obtained feedback data indicative of a changed feedback path of the hearing prosthesis, including, optionally, the recorded feedback data, can include one or more or all of data that includes standard deviation, mean median, mode, maximum, minimum, error, etc. in an exemplary embodiment, the feedback data indicative of a changed feedback path can be obtained in a continuous manner or in defined intervals, or a combination thereof.

Referring back to FIG. 6, it is noted that the hearing prosthesis 600 includes feedback data logger 638. Feedback data logger 638 can include a memory that records or otherwise logs the obtained feedback data indicative of a changed feedback path of the hearing prosthesis of method action 710. This obtained feedback data stored/logged in feedback data logger 638 can be accessed via I/O block 670 so that it can be utilized by a clinician or the like. Alternatively or in addition to this, because in some embodiments prosthesis 600 is configured to execute, optionally automatically, one or more or all of the method actions detailed herein and/or variations thereof, prosthesis 600 is configured, utilizing the data logged by feedback data logger 638 to execute method 700.

As noted above, I/O block 670 can communicate with a personal computer of an audiologist, so that the system (fitting computer and prosthesis 600) can be utilized to execute one or more or all of the method actions detailed herein an/or variations thereof. Also, I/O block 670 can be utilized to communicate the data of the feedback data logger 638 to a computer so that the data can be analyzed.

While various embodiments of the present invention have been described above, it should be understood that they have been presented by way of example only, and not limitation. It will be apparent to persons skilled in the relevant art that various changes in form and detail can be made therein without departing from the spirit and scope of the invention. Thus, the breadth and scope of the present invention should not be limited by any of the above-described exemplary embodiments, but should be defined only in accordance with the following claims and their equivalents.

What is claimed is:

1. A method, comprising:

obtaining feedback data indicative of a changed feedback path of a hearing prosthesis used by a recipient; and adjusting a parameter of the hearing prosthesis that changes a performance feature of the hearing prosthesis based on the obtained feedback data, wherein the parameter is a feedback influenceable parameter, and the method further includes, prior to the action of adjusting the feedback influenceable parameter, evaluating the obtained feedback data.

2. The method of claim 1, further comprising:

prior to the action of adjusting the feedback influenceable parameter, automatically generating a suggestion to adjust the feedback influenceable parameter base on the automatic evaluation of the obtained feedback data, wherein the action of evaluating the obtained feedback data is executed automatically.

3. The method of claim 1, wherein the parameter is at least one of:

a speed at which changes to a feedback cancellation system of the hearing prosthesis are implemented as result of a learning feature of the system; or an adaption time of a feedback cancellation algorithm of the hearing prosthesis.

4. The method of claim 1, wherein:

the feedback path includes a portion extending through solid matter, which portion corresponds to the changed feedback path.

5. The method of claim 1, wherein:

the hearing prosthesis is a percutaneous bone conduction device, and the feedback data is indicative of a change in an interface of the percutaneous bone conduction device and the recipient.

6. The method of claim 1, wherein at least one of:

the obtained feedback data is based on at least one of frequency responses or impulse responses of the hearing prosthesis; or the obtained feedback data is indicative of at least one of temporally varying frequency responses or temporally varying impulse responses of the hearing prosthesis.

7. The method of claim 1, wherein:

the parameter that is adjusted is a safety factor gain margin component of the hearing prosthesis.

8. The method of claim 1, wherein:

the hearing prosthesis includes a feedback cancellation system;

the method further comprises the hearing prosthesis evaluating real-time changes to filter coefficients of the feedback cancellation system over a period of time; and the action of adjusting the parameter entails adjusting the feedback cancellation system based on the changes to the filter coefficients.

9. The method of claim 1, wherein:

the adjustment is in the form of real-time changes to filter coefficients of a filter of the hearing prosthesis.

10. The method of claim 1, wherein:

the feedback data is data based on an adaptive part of a feedback cancellation system of the hearing prosthesis.

11. The method of claim 1, wherein:

the feedback data is obtained automatically by the hearing prosthesis; and the parameter is adjusted automatically by the hearing prosthesis.

12. The method of claim 1, wherein:

the obtained feedback data is based on a state of a connection of a removable component of the hearing prosthesis to a recipient; and the hearing prosthesis is a percutaneous bone conduction device, and the state of the connection of the hearing prosthesis corresponds to a releasable coupling of the percutaneous bone conduction device.

13. A device, comprising:

an implantable hearing prosthesis configured to at least one of record data based on feedback of the hearing prosthesis or detect a change in a state of the hearing prosthesis, wherein the implantable hearing prosthesis is one of a percutaneous bone conduction device or an implantable mechanical stimulator configured to be implanted beneath skin of the recipient.

14. The device of claim 13, wherein:

a hearing prosthesis includes a system configured to be adjusted to vary a parameter that influences a hearing percept evoking output of the hearing prosthesis, wherein the hearing prosthesis is configured to automatically adjust the system based on at least one of the recorded data or the detected change in state.

15. The device of claim 14, wherein:

the parameter is a set gain margin of the hearing prosthesis.

16. The device of claim 13, wherein:

the hearing prosthesis comprises an adaptive feedback reduction system that includes filters having variable filter coefficients, wherein the hearing prosthesis is configured to vary the filter coefficients to adapt the feedback reduction system; and the hearing prosthesis is configured to record data indicative of the variation in the filter coefficients due to the adaptation of the feedback reduction system.

17. A device, comprising:

an implantable hearing prosthesis configured to at least one of record data based on feedback of the hearing prosthesis or detect a change in a state of the hearing prosthesis, wherein the hearing prosthesis is configured to detect a change in a state of the hearing prosthesis, wherein the state of the hearing prosthesis is at least one of a state of a mechanical component establishing a connection of the hearing prosthesis to a recipient or a state of a surgical attachment of the hearing prosthesis to the recipient.

18. The device of claim 13, wherein:

the hearing prosthesis is configured to detect a change in a state of the hearing prosthesis; and the state of the hearing prosthesis is a state of a feature setting of the hearing prosthesis.

19. The device of claim 17, wherein:

the implantable hearing prosthesis includes a component that is configured to be located at a location beneath skin of the recipient that is subject to vibrations produced by the hearing prosthesis that conducts those vibrations to tissue of the recipient to evoke a hearing percept.

20. The method of claim 1, wherein:

the hearing prosthesis is a percutaneous bone conduction device.

21. The device of claim 17, wherein:

the implantable hearing prosthesis is a percutaneous bone conduction device.

* * * * *